US007485797B2

(12) United States Patent
Sumita

(10) Patent No.: US 7,485,797 B2
(45) Date of Patent: Feb. 3, 2009

(54) CHORD-NAME DETECTION APPARATUS AND CHORD-NAME DETECTION PROGRAM

(75) Inventor: Ren Sumita, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 0 days.

(21) Appl. No.: 11/780,717

(22) Filed: Jul. 20, 2007

(65) Prior Publication Data

US 2008/0034947 A1 Feb. 14, 2008

(30) Foreign Application Priority Data

Aug. 9, 2006 (JP) ..... 2006-216361

(51) Int. Cl.
*G10H 1/38* (2006.01)
*G10H 7/00* (2006.01)

(52) U.S. Cl. ..... 84/613; 84/609; 84/611; 84/616; 84/637; 84/649; 84/654; 84/669

(58) Field of Classification Search ..... None
See application file for complete search history.

(56) References Cited

U.S. PATENT DOCUMENTS

| | | | | |
|---|---|---|---|---|
| 7,181,021 | B2 * | 2/2007 | Raptopoulos et al. | 381/71.14 |
| 7,288,710 | B2 * | 10/2007 | Gayama | 84/609 |
| 7,335,834 | B2 * | 2/2008 | Gayama | 84/613 |
| 2003/0026436 | A1 * | 2/2003 | Raptopoulos et al. | 381/71.4 |
| 2008/0034948 | A1 * | 2/2008 | Sumita | 84/636 |
| 2008/0078282 | A1 * | 4/2008 | Saijo | 84/611 |

FOREIGN PATENT DOCUMENTS

JP 05-100661 A 4/1993

* cited by examiner

*Primary Examiner*—Marlon T Fletcher
(74) *Attorney, Agent, or Firm*—Sughrue Mion, PLLC

(57) ABSTRACT

When a first bar-division determination section determines that the bass note changes in a bar or when a second bar-division determination section determines that the degree of change in the chord in the bar is large, a chord-name determination section divides the bar and detects chords. This operation allows correct chords to be detected even when the chord changes within a bar, while the bass note is maintained.

4 Claims, 11 Drawing Sheets

TENTATIVE BEAT POSITION

WHEN $\sigma = \sqrt{\dfrac{-1}{2 \cdot \log_e(0.4)}}$ $$k = e^{-\frac{\left|\frac{s}{\tau_{max} \cdot F}\right|^3}{2 \cdot \sigma^2}}$$

NORMALIZATION TO SMALLEST

PowerOfNote1

PowerOfNote2

CHORD-NAME DETECTION APPARATUS AND CHORD-NAME DETECTION PROGRAM

BACKGROUND OF THE INVENTION

1. Field of the Invention

The present invention relates to a chord-name detection apparatus and a chord-name detection program.

2. Discussion of Background

A chord-name detection apparatus has been developed for detecting a chord name from a musical acoustic signal (audio signal) in which the sounds of a plurality of musical instruments are mixed, such as the audio signals of music compact discs (CDs).

In that apparatus, a bass note is used to determine whether a plurality of chords is used in a bar. More specifically, each bar is divided into a first half and a second half; a bass note is detected in each half; and when different bass notes are detected in the first half and the second half, the chord is also detected in each of the first half and the second half.

In that method, however, when different chords are used but an identical bass note is detected, for example, when the C chord is used in the first half of a bar and the Cm chord is used in the second half, since the bass note is identical, the bar is not divided and the C chord is detected in the whole bar.

In addition, in the above apparatus, the bass note is detected in the entire detection zone. In other words, when the detection zone is a bar, a strong note in the entire bar is detected as the bass note. In jazz music where the bass note changes frequently (the bass note changes in units of quarter notes or the like), however, the bass note cannot be detected correctly with this method.

SUMMARY OF THE INVENTION

The present invention has been made to resolve the foregoing problems. Accordingly, it is an object of the present invention to provide a chord-name detection apparatus and a chord-name detection program capable of detecting correct chords even if the chord changes in a bar while an identical bass note is maintained.

To achieve the foregoing object, the present invention provides, in its first aspect, a chord-name detection apparatus. The chord-name detection apparatus includes input means for receiving an acoustic signal; first scale-note-power detection means for applying a fast Fourier transform (FFT) to the received acoustic signal at predetermined frame intervals by using parameters suited to beat detection and for obtaining the power of each note in a scale at each frame interval from the obtained power spectrum; beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers; bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat; second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum; bass-note detection means for setting several detection zones in each bar and for detecting a bass note in each of the detection zones from the power of a low note in the scale at a portion corresponding to a first beat in each of the detection zones among the detected power of each note in the scale; first bar-division determination means for determining whether the bass note is changed according to whether the detected bass note in each of the detection zones is different and for determining whether it is necessary to divide the bar into a plurality of portions according to whether the bass note is changed; second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for re-arranging the powers in descending order of strength, for determining whether a chord is changed according to whether C notes or more of the top M strongest notes, M being three or more, in the scale in a detection zone are included in the top N strongest notes, N being three or more, in the scale in the detection zone immediately therebefore, and for determining whether it is necessary to divide the bar into a plurality of portions according to the degree of change in the chord; and chord-name determination means for determining, when the first bar-division determination means and/or the second bar-division determination means determine that it is necessary to divide the bar into several chord detection zones, a chord name in each of the chord detection zones according to the bass note and the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

In the above structure, the bar is divided depending not only on the bass note but also on the degree of change in the chord. When the bass note is different, or when the degree of change in the chord is large, the bar is divided and chords are detected. The bar division is not limited to a division into a first half and a second half. When a musical piece has a quadruple meter, the bar may be divided into four portions by dividing each of a first half and a second half into further halves. Depending on a case, the bar may be further divided. The bass note is not detected in the entire detection zone but detected in a portion corresponding to the first beat in the detection zone. This is because the root notes of the chord are played at the first beat in many cases even when the bass note is changed frequently.

The bass note is detected in the same way as in the previously developed apparatus described above. Specifically, a fast Fourier transform (FFT) is applied to an input waveform at predetermined time intervals (frames); the power of each note in a scale at each frame interval is obtained from the obtained power spectrum; an incremental value of the power of each note in the scale is calculated for each frame interval; the incremental value of the power of each note in the scale is summed up for all the notes in the scale to obtain the degree of change of all the notes at each frame interval; and beats (an average beat interval and the position of each beat) are detected from the degree of change of all the notes at each frame interval. When the beats are detected, the average power of each note in the scale is calculated for each beat interval, an incremental value of the average power of each note in the scale for each beat is calculated; the incremental value of the average power of each note is summed up for all the notes to obtain the degree of change of all the notes at each beat; and a meter and the position of a bar line are detected from the degree of change of all the notes at each beat. Since the bar is detected in this manner, the bar is divided into a first half and a second half and the bass note is detected in each of them. Among the powers of the notes in the scale at each frame interval, obtained above, the powers of notes in a base range (for example, from E1 to E3) in the detection zone are averaged and the note having a large average power is determined as the bass note. Alternatively, the average powers of 12 pitch notes are obtained and the pitch note having the largest value is determined as the bass note.

In the previously developed apparatus described above, the powers in the detection zone are averaged and a note having a large average power is determined as the bass note. In the present invention, however, the bass note is detected at a portion corresponding to the first beat in the detection zone. The reason is as described above. The detection procedure and structure are the same as in the previously developed apparatus described above.

The bar division depending on the degree of change in the chord, which is a feature of the present invention, will be described next.

In the present invention, the bar is divided depending not only on the bass note but also on the degree of change in the chord. The degree of change in the chord is calculated in the following way. A chord detection range is first specified. The chord detection range is a range where chords are mainly played and is assumed, for example, to be in the range from C3 to E6 (C4 serves as the center "do").

The power of each note in the scale for each frame interval in the chord detection range is averaged in a detection zone, such as half of a bar. The averaged power of each note in the scale is summed up for each of 12 pitch notes (C, C#, D, D#, . . . , and B), and the summed-up power is divided by the number of powers summed up to obtain the average power of each of the 12 pitch notes.

The average powers of the 12 pitch notes are obtained in the chord detection range for the first half and second half of the bar and are re-arranged in descending order of strength.

As shown in FIG. 15A and FIG. 15B, it is determined whether the top three (this number is called "M") notes, for example, in strength in the second half are included in the top three (this number is called "N") notes, for example, in strength in the first half.

When the three notes (this number is called "C") or more are included (that is, all three are included), it is determined that the chord does not change between the first half and the second half of the bar, and the division of the bar depending on the degree of change in the chord needs not be performed.

Setting the values of "M", "N", and "C" appropriately changes how the bar is divided depending on the degree of change in the chord. In the foregoing example, where "M", "N", and "C" are all set to "3", a change in the chord is rather strictly checked. When "M" is set to "3", "N" is set to "6", and "C" is set to "3" (which means determining whether the top three notes in the second half are all included in the top six notes in the first half), for example, it is determined that pieces of sound similar to each other to some extent have an identical chord.

A description has been given in which the first half and the second half are each further divided into two halves to have four divisions in the bar in the quadruple meter. A more correct determination suited to actual general music can be made, setting "M" to "3", "N" to "3" and "C" to "3" when determining whether to divide the bar into the first half and the second half and setting "M" to "3", "N" to "6" and "C" to "3" when determining whether to divide each of the first half and the second half into two further halves.

In the configuration of the present embodiment, since the bar is divided according to not only the bass note but also the degree of change in the chord to detect the chord, even if the bass note is identical, when the degree of change in the chord is large, the bar is divided and the chords are detected. In other words, if the chord changes in a bar with an identical bass note being maintained, for example, the correct chords can be detected. The bar can be divided in various ways according to the degree of change in the bass note and the degree of change in the chord.

In the configuration of a second aspect of the present invention, the structure for dividing the bar depending on the degree of change in the chord in the first aspect of the present invention is changed.

Specifically, to achieve the foregoing object, the present invention provides, in the second aspect, a chord-name detection apparatus. The chord-name detection apparatus includes input means for receiving an acoustic signal; first scale-note-power detection means for applying a fast Fourier transform (FFT) to the received acoustic signal at predetermined frame intervals by using parameters suited to beat detection and for obtaining the power of each note in a scale at each frame interval from the obtained power spectrum; beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers; bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat; second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum; bass-note detection means for setting several detection zones in each bar and for detecting a bass note in each of the detection zones from the power of a low note in the scale at a portion corresponding to a first beat in each of the detection zones among the detected power of each note in the scale; first bar-division determination means for determining whether the bass note is changed according to whether the detected bass note in each of the detection zones is different and for determining whether it is necessary to divide the bar into a plurality of portions according to whether the bass note is changed; second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for normalizing the average power of each of the 12 pitch notes in the scale to the smallest power, for calculating the Euclidean distance of the normalized power of each of the 12 pitch notes in the scale, for determining whether a chord is changed according to whether the Euclidean distance is larger than "T" multiplied by the average of the powers of all the notes in all the frames, the Euclidean distance is larger than "T" multiplied by the average of the powers of all the notes in all the frames, and for determining whether it is necessary to divide the bar into a plurality of portions according to the degree of change in the chord; and chord-name determination means for determining when the first bar-division determination means and/or the second bar-division determination means determine that it is necessary to divide the bar into several chord detection zones, a chord name in each of the chord detection zones according to the bass note and the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

The configuration of the second aspect of the present invention differs from that of the first aspect in that the Euclidean distance of the power of each note in the scale is calculated to determine the degree of change in the chord to divide a bar and to detect chords.

In that case, however, if the Euclidean distance is simply calculated, it becomes large at a sudden sound increase (at the start of a musical piece or the like) and a sudden sound attenuation (at the end of a musical piece or a break), causing the risk of dividing the bar just due to magnifications of the sound even though the chord actually has no change. Therefore, before the Euclidean distance is calculated, the power of each note in the scale is normalized as shown in FIGS. 17A to 17D (the powers shown in FIG. 17A are normalized to those shown in FIG. 17C, and the powers shown in FIG. 17B are normalized to those shown in FIG. 17D). When normalization to the smallest power, not to the largest power, is performed (see FIGS. 17A to 17D), the Euclidean distance is reduced at a sudden sound change, eliminating the risk of erroneously dividing the bar.

The Euclidean distance of the power of each note in the scale is calculated by the following expression 16.

Euclidean distance = Expression 16

$$\sqrt{\sum_{i=0}^{11}\left(\begin{matrix}PowerOfNote2[i]-\\PowerOfNote1[i]\end{matrix}\right)*\left(\begin{matrix}PowerOfNote2[i]-\\PowerOfNote1[i]\end{matrix}\right)}$$

PowerOfNote1: Array of the average power of each of 12 pitch notes in chord detection zone 1 (12 notes from C to B)

PowerOfNote2: Array of the average power of each of 12 pitch notes in chord detection zone 2 (12 notes from C to B)

When the Euclidean distance is larger than the average of the powers of all the notes in all frames, for example, the bar is divided.

To be more detailed, when the Euclidean distance is larger than "T" multiplied by the average of the powers of all the notes in all the frames, it is necessary to divide the bar. When the value "T" is changed, the bar-division threshold can be changed (adjusted) to a desired value.

In third and fourth aspects of the present invention, computer programs read and executed by a computer to cause the computer to function as the chord-name detection apparatuses in the first and second aspects, respectively, are provided.

More specifically, as structures for handling the above-described issues, computer programs are disclosed which are read and executable by a computer to realize the processing means in the structures of the chord-name detection apparatuses specified in the first and second aspects of the present invention, by using the structure of the computer. These structures may be provided not only by the computer programs but also by recording media that have stored programs having the same functions as the computer programs described above, as described later. The computer may be not only a general-purpose computer having a central processing unit but also a special-purpose computer. The computer needs to have a central processing unit but there are no other special limitations.

When such programs for executing the above-described processing is read by the computer, the same processing is executed as that achieved by the means of the apparatuses specified in the first and second aspects of the present invention.

When an existing hardware resource is used to execute one of the above computer programs, the existing hardware resource easily realizes the chord-name detection apparatus specified correspondingly to the first or second aspect, as new application. In addition, when the computer programs are recorded in the above-described recording media, the programs can be easily distributed or sold as software products. Furthermore, in addition to the above-described form, the recording media may be internal storage devices such as RAMs or ROMs or external storage devices such as hard disks. When such a program is recorded in a device, that device is included in the recording media specified in the present invention.

Functions executing a part of processing performed by the means specified in the third and fourth aspects of the present invention, described later; may be implemented by functions built in the computer (functions integrated in the computer in a hardware manner or functions implemented by an operating system or other application program installed in the computer) and the programs of the third and fourth aspects may include instructions for calling or linking the functions achieved by the computer.

When a part of the means specified in the third and fourth aspects is achieved by a part of functions implemented, for example, by the operating system, a program or module that implements that function is not directly recorded. However, when a part of functions of the operating system that implements the function is called or linked, substantially the same structure is achieved.

The programs themselves can be used, can be recorded in recording media to be distributed or sold, as described later, and can be transmitted by communication to be handed over.

The configuration of the third aspect of the present invention corresponds to that of the first aspect. Specifically, to achieve the foregoing object, the present invention provides, in the third aspect, a chord-name detection program. The chord-name detection program is read and executed by a computer to cause the computer to function as: input means for receiving an acoustic signal; first scale-note-power detection means for applying a fast Fourier transform (FFT) to the received acoustic signal at predetermined frame intervals by using parameters suited to beat detection and for obtaining the power of each note in a scale at each frame interval from the obtained power spectrum; beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers; bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat; second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum; bass-note detection means for setting several detection zones in each bar and for detecting a bass note in each of the detection zones from the power of a low note in the scale at a portion corresponding to a first beat in each of the detection zones among the detected power of each note in the scale; first bar-division determination means for determining whether the bass note is changed according to whether the detected bass note in each of the detection zones is different and for determining whether it is necessary to divide the bar into a plurality of portions according to whether the bass note is changed; second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for re-arranging the powers in descending order of strength, for determining whether a chord is changed according to whether C notes or more of the top M strongest notes, M being three or more, in the scale in a detection zone are included in the top N strongest notes, N being three or more, in the scale in the detection zone immediately therebefore, and for determining whether it is necessary to divide the bar into a plurality of portions according to the degree of change in the chord; and chord-name determination means for determining, when the first bar-division determination means and/or the second bar-division determination means determine that it is necessary to divide the bar into several chord detection zones, a chord name in each of the chord detection zones according to the bass note and the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

The configuration of the fourth aspect of the present invention corresponds to that of the second aspect. Specifically, to achieve the foregoing object, the present invention provides, in the fourth aspect, a chord-name detection program. The chord-name detection program is read and executed by a computer to cause the computer to function as: input means for receiving an acoustic signal; first scale-note-power detection means for applying a fast Fourier transform (FFT) to the received acoustic signal at predetermined frame intervals by using parameters suited to beat detection and for obtaining the power of each note in a scale at each frame interval from the obtained power spectrum; beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers; bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat; second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum; bass-note detection means for setting several detection zones in each bar and for detecting a bass note in each of the detection zones from the power of a low note in the scale at a portion corresponding to a first beat in each of the detection zones among the detected power of each note in the scale; first bar-division determination means for determining whether the bass note is changed according to whether the detected bass note in each of the detection zones is different and for determining whether it is necessary to divide the bar into a plurality of portions according to whether the bass note is changed; second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for normalizing the average power of each of the 12 pitch notes in the scale to the smallest power, for calculating the Euclidean distance of the normalized power of each of the 12 pitch notes in the scale, for determining whether a chord is changed according to whether the Euclidean distance is larger than "T" multiplied by the average of the powers of all the notes in a 1 the frames, the Euclidean distance is larger than "T" multiplied by the average of the powers of all the notes in all the frames, and for determining whether it is necessary to divide the bar into a plurality of portions according to the degree of change in the chord; and chord-name determination means for determining, when the first bar-division determination means and/or the second bar-division determination means determine that it is necessary to divide the bar into several chord detection zones, a chord name in each of the chord detection zones according to the bass note and the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

According to the chord-name detection apparatuses and the chord-name detection programs in the first to fourth aspects of the present invention, even when the chord is changed in a bar with the bass note being maintained, correct chords can be detected.

DETAILED DESCRIPTION OF THE PREFERRED EMBODIMENTS

Figure 1:
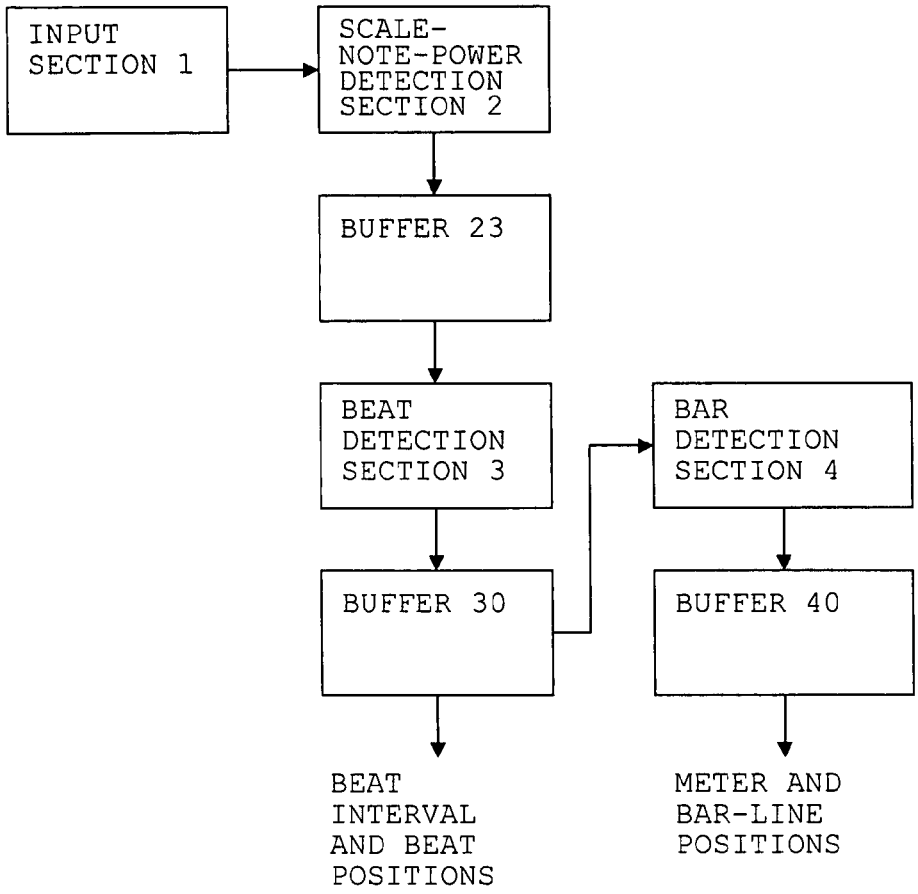
FIG. 1 is a block diagram of a tempo detection apparatus which has been previously proposed.

Embodiments of the present invention will be described below by referring to the drawings.

FIG. 1 is a block diagram of a tempo detection apparatus which has been previously developed. In the figure, the tempo detection apparatus includes an input section 1 for receiving an acoustic signal; a scale-note-power detection section 2 for applying a fast Fourier transform (FFT) to the received acoustic signal at predetermined time intervals (frames) and for obtaining the power of each note in a scale at each frame interval from the obtained power spectrum; a beat detection section 3 for summing up, for all the notes in the scale, an incremental value of the power of each note in the scale at each frame interval to obtain the total of the incremental values of the powers, indicating the degree of change of all the notes at each frame interval, and for detecting an average beat interval and the position of each beat, from the total of the incremental values of the powers; and a bar detection section 4 for calculating the average power of each note in the scale for each beat, for summing up, for all the notes, an incremental value of the average power of each note in the scale for each beat to obtain a value indicating the degree of change of all the notes at each beat, and for detecting a meter and the position of a bar line, from the value indicating the degree of change of all the notes at each beat.

The input section 1 receives a musical acoustic signal from which the tempo is to be detected. An analog signal received from a microphone or other device may be converted to a digital signal by an A-D converter (not shown), or digitized musical data, such as that in a music CD, may be directly taken (ripped) as a file and opened. When a digital signal received in this way is a stereo signal, it is converted to a monaural signal to simplify subsequent processing.

Figure 2:
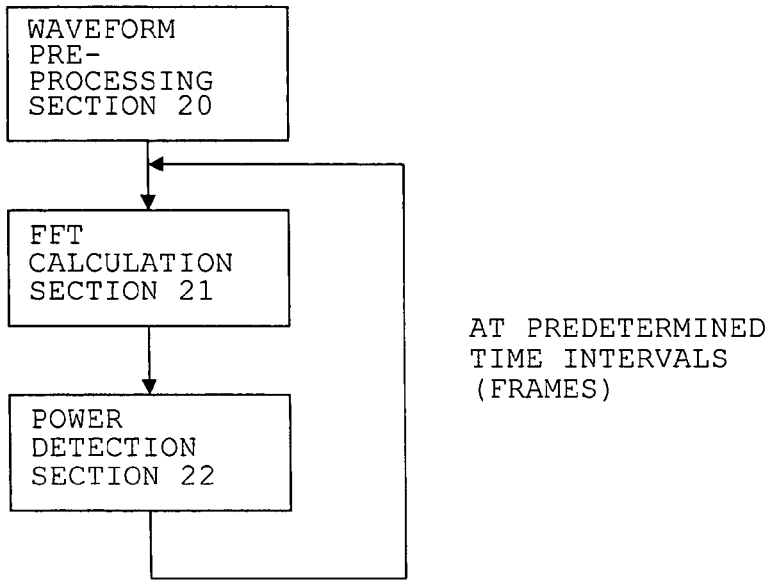
FIG. 2 is a block diagram of a scale-note-power detection section in the tempo detection apparatus.

The digital signal is input to the scale-note-power detection section 2. The scale-note-power detection section 2 is formed of sections shown in FIG. 2.

Among them, a waveform pre-processing section 20 down-samples the acoustic signal sent from the input section 1, at a sampling frequency suited to subsequent processing.

The down-sampling rate is determined by the range of a musical instrument used for beat detection. Specifically, to use the performance sounds of rhythm instruments having a high range, such as cymbals and hi-hats, for beat detection, it is necessary to set the sampling frequency after down-sampling to a high frequency. To mainly use the bass note, the sounds of musical instruments such as bass drums and snare drums, and the sounds of musical instruments having a middle range for beat detection, it is not necessary to set the sampling frequency after down-sampling to such a high frequency.

When it is assumed that the highest note to be detected is A6 (C4 serves as the center "do"), for example, since the fundamental frequency of A6 is about 1,760 Hz (when A4 is set to 440 Hz), the sampling frequency after down-sampling needs to be 3,520 Hz or higher, and the Nyquist frequency is thus 1,760 Hz or higher. Therefore, when the original sampling frequency is 44.1 kHz (which is used for music CDs), the down-sampling rate needs to be about one twelfth. In this case, the sampling frequency after down-sampling is 3,675 Hz.

Usually in down-sampling processing, a signal is passed through a low-pass filter which removes components having the Nyquist frequency (1,837.5 Hz in the current case), that is, half of the sampling frequency after down-sampling, or higher, and then data in the signal is skipped (11 out of 12 waveform samples are discarded in the current case).

Down-sampling processing is performed in this way in order to reduce the FFT calculation time by reducing the number of FFT points required to obtain the same frequency resolution in FFT calculation to be performed after the down-sampling processing.

Such down-sampling is necessary when a sound source has already been sampled at a fixed sampling frequency, as in music CDs. However, when an analog signal input from a microphone or other device to the input section 1 is converted to a digital signal by the A-D converter, the waveform pre-processing section 20 can be omitted by setting the sampling frequency of the A-D converter to the sampling frequency after down-sampling.

When down-sampling is finished in this way in the waveform pre-processing section 20, an FFT calculation section 21 applies FFT to the output signal of the waveform preprocessing section 20 at predetermined time intervals (frames).

FFT parameters (number of FFT points and FFT window shift) should be set to values suitable for beat detection. Specifically, if the number of FFT points is increased to increase the frequency resolution, the FFT window size is enlarged to use a longer time period for one FFT cycle, reducing the time resolution. This FFT characteristic needs to be taken into account. (In other words, for beat detection, it is better to increase the time resolution with the frequency resolution suppressed.) There is a method in which, instead of using a waveform having the same length as the window length, waveform data is specified only for a part of the window and the remaining part is filled with zeros to increase the number of FFT points without suppressing the time resolution. However, the number of waveform samples needs to be set up to a certain point in order to also detect a low-note power correctly.

The above points have been taken into account. In the apparatus, the number of FFT points is set to 512, the window shift is set to 32 samples (window overlap is 15/16), and filling with zeros is not performed. When the FFT calculation is performed with these settings, the time resolution is about 8.7 ms, and the frequency resolution is about 7.2 Hz. A time resolution of 8.7 ms is sufficient because the length of a thirty-second note is 25 ms in a musical piece having a tempo of 300 quarter notes per minute.

The FFT calculation is performed in this way in each frame interval; the squares of the real part and the imaginary part of the FFT result are added and the sum is square-rooted to calculate the power spectrum; and the power spectrum is sent to a power detection section 22.

The power detection section 22 calculates the power of each note in the scale from the power spectrum calculated in the FFT calculation section 21. The FFT calculates just the powers of frequencies that are integer multiples of the value obtained when the sampling frequency is divided by the number FFT points. Therefore, the following process is performed to detect the power of each note in the scale from the power spectrum. The power of the spectrum having the maximum power among power spectra corresponding to the frequencies falling in the range of 50 cents (100 cents correspond to one semitone) above and below the fundamental frequency of each note (from C1 to A6) in the scale is set to the power of the note.

When the powers of all the notes in the scale have been detected, they are stored in a buffer. The waveform reading position is advanced by a predetermined time interval (one frame, which corresponds to 32 samples in the above case), and the processes in the FFT calculation section 21 and the power detection section 22 are performed again. This set of steps is repeated until the waveform reading position reaches the end of the waveform.

With the above-described processing, the power of each note in the scale for each predetermined time interval is stored in the buffer 23 for the acoustic signal input to the input section 1.

Figure 3:
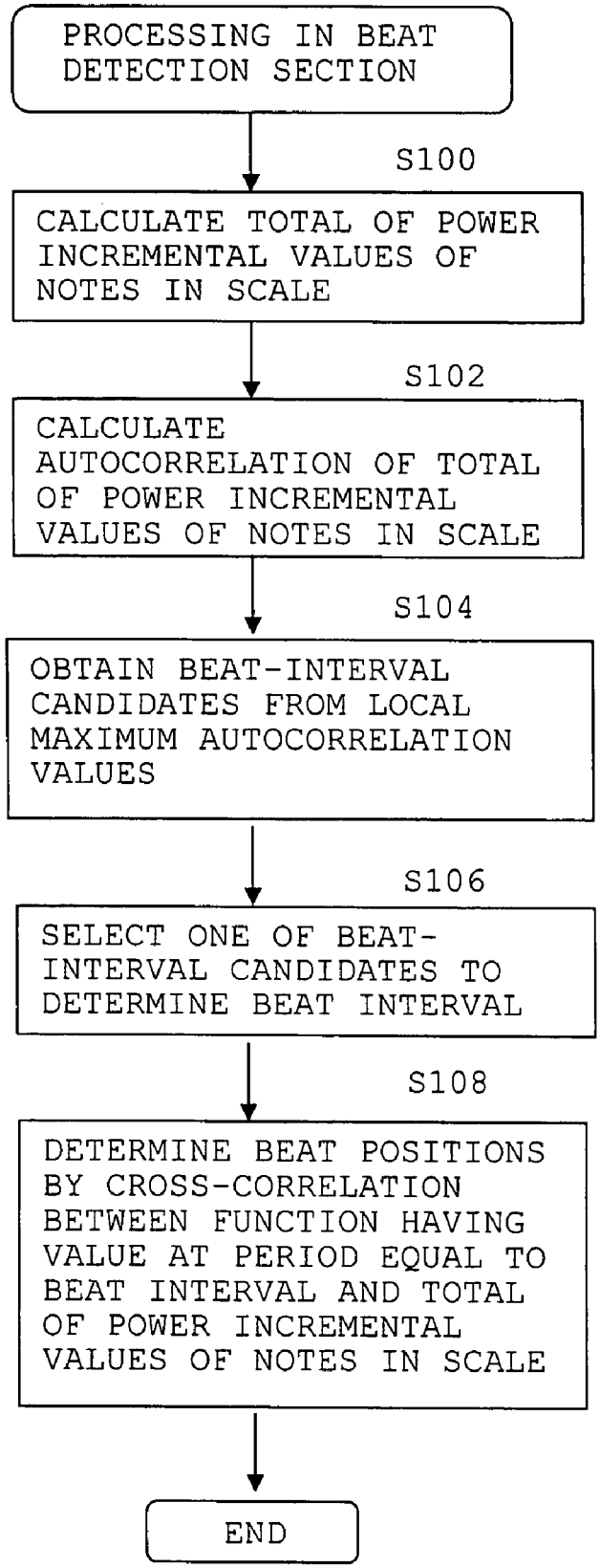
FIG. 3 is a flowchart showing a processing flow in a beat detection section in the tempo detection apparatus.

The structure of the beat detection section 3, shown in FIG. 1, will be described next. The beat detection section 3 performs processing according to a procedure as shown in FIG. 3.

The beat detection section 3 detects an average beat interval (that is, tempo) and the positions of beats, based on a change in the power of each note in the scale for each frame interval, the power being output from the scale-note-power detection section 2. The beat detection section 3 first calculates, in step S100, the total of incremental values of the powers of the notes in the scale (the total of the incremental values in power from the preceding frame for all the notes in the scale; if the power is reduced from the preceding frame, zero is added).

When the power of the i-th note in the scale at frame time "t" is called $L_i(t)$, an incremental value $L_{addi}(t)$ of the power of the i-th note is as shown in the following expression 1. The total L(t) of incremental values of the powers of all the notes in the scale at frame time "t" can be calculated by the following expression 2, where T indicates the total number of notes in the scale.

$$L_{addi}(t) = \begin{cases} L_i(t) - L_i(t-1) & (\text{when } L_i(t-1) \leqq L_i(t)) \\ 0 & (\text{when } L_i(t-1) > L_i(t)) \end{cases} \quad \text{Expression 1}$$

$$L(t) = \sum_{i=O}^{T-1} L_{addi}(t) \quad \text{Expression 2}$$

The total value L(t) indicates the degree of change in all the notes in each frame interval. This value suddenly becomes large when notes start sounding and increases when the number of notes that start sounding at the same time increases. Since notes start sounding at the position of a beat in many musical pieces, it is highly possible that the position where this value becomes large is the position of a beat.

Figure 4:
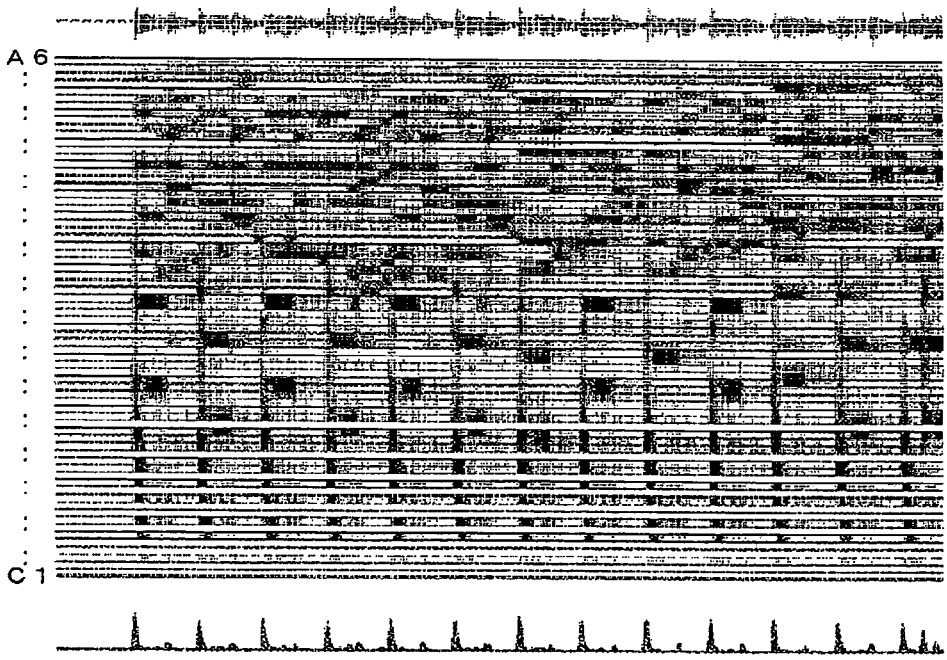
FIG. 4 is a graph showing the waveform of a part of a musical piece, the power of each note in a scale, and the total of the power incremental values of the notes in the scale.

As an example, FIG. 4 shows the waveform of a part of a musical piece, the power of each note in the scale, and the total of the incremental values in power of the notes in the scale. The upper row indicates the waveform, the middle row indicates the power of each note in the scale for each frame interval with black and white gradation (in the range of C1 to A6 in this figure, with a lower note at a lower position and a higher note at a higher position), and the lower row indicates the total of the incremental values in power of the notes for each frame interval. Since the power of each note in the scale shown in this figure is output from the scale-note-power detection section 2, the frequency resolution is about 7.2 Hz; the powers of some notes (G#2 and lower) in the scale cannot be calculated and are not shown. Even though the powers of some low notes cannot be measured, there is no problem because the purpose is to detect beats.

As shown in the lower row in the figure, the total of the incremental values in power of the notes in the scale has peaks periodically. The positions of these periodic peaks are those of beats.

To obtain the positions of beats, the beat detection section 3 first obtains the time difference between these periodic peaks, that is, the average beat interval. The average beat interval can be obtained from the autocorrelation of the total of the incremental values in power of the notes in the scale (in step S102 in FIG. 3).

The autocorrelation $\phi(\tau)$ of the total L(t) of the incremental values in power of the notes in the scale at frame time "t" is given by the following expression 3:

$$\phi(\tau) = \frac{\sum_{t=0}^{N-\tau-1} L(t) \cdot L(t+\tau)}{N-\tau} \quad \text{Expression 3}$$

where N indicates the total number of frames and $\tau$ indicates a time delay.

Figure 5:
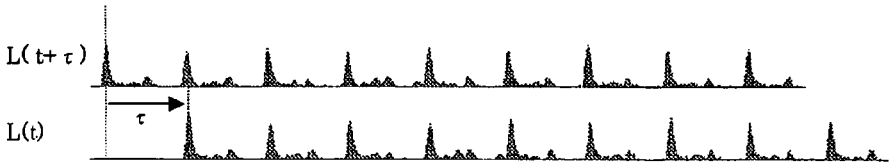
FIG. 5 is a view showing the concept of autocorrelation calculation.

FIG. 5 shows the concept of the autocorrelation calculation. As shown in the figure, when the time delay "$\tau$" is an integer multiple of the period of peaks of L(t), $\phi(\tau)$ becomes a large value. Therefore, when the maximum value of $\phi(\tau)$ is obtained in a prescribed range of "$\tau$", the tempo of the musical piece is obtained.

The range of "$\tau$" where the autocorrelation is obtained needs to be changed according to an expected tempo range of the musical piece. For example, when calculation is performed in a range of 30 to 300 quarter notes per minute in metronome marking, the range where autocorrelation is calculated is from 0.2 to 2.0 seconds. The conversion from time (seconds) to frames is given by the following expression 4.

$$\text{Number of frames} = \frac{\text{time (seconds)} \times \text{sampling frequency}}{\text{number of samples per frame}} \quad \text{Expression 4}$$

The beat interval may be set to "$\tau$" where the autocorrelation $\phi(\tau)$ is maximum in the range. However, since "$\tau$" where the autocorrelation is maximum in the range is not necessarily the beat interval for all musical pieces, it is desired that candidates for the beat interval be obtained from "$\tau$" values where the autocorrelation is local maximum in the range (in step S104 in FIG. 3) and that the user be asked to determine the beat interval from those plural candidates (in step S106 in FIG. 3).

When the beat interval is determined in this way (the determined beat interval is called "$\tau_{max}$"), the starting beat position is determined first.

Figure 6:
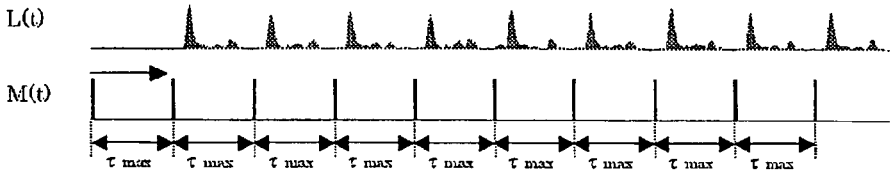
FIG. 6 is a view showing a method for determining the starting beat position.

A method for determining the starting beat position will be described with reference to FIG. 6. In FIG. 6, the upper row indicates L(t), the total of the incremental values in power of the notes in the scale at frame time "t", and the lower row indicates M(t), a function having a value at integer multiples of the determined beat interval "$\tau_{max}$". The function M(t) is expressed by the following expression 5.

$$M(t) = \begin{cases} 1 & (\text{when "}t\text{" is an integer multiple of "}\tau_{\max}\text{"}) \\ 0 & (\text{otherwise}) \end{cases} \quad \text{Expression 5}$$

The cross-correlation of L(t) and M(t) is calculated with the function M(t) shifted in a range of 0 to "$T_{max}$"−1.

The cross-correlation r(s) can be calculated from the characteristics of the function M(t) by the following expression 6.

$$r(s) = \sum_{j=0}^{n-1} L(\tau_{\max} \cdot j + s) \quad \text{Expression 6}$$

$$(0 \leqq s < \tau_{\max})$$

In this case, "n" needs to be determined appropriately according to the length of a top no-sound part ("n"=10 in the case shown in FIG. 6).

The cross-correlation r(s) is obtained in the range where "s" is changed from 0 to "$\tau_{max}$"−1. The starting beat position is in the s-th frame where "s" maximizes r(s).

Once the starting beat position is determined, subsequent beat positions are determined one by one (in step S108 in FIG. 3).

A method therefor will be described with reference to FIG. 7. It is assumed that the starting beat was found at the position of the triangular mark in FIG. 7. The second beat position is determined to be a position where cross-correlation between L(t) and M(t) becomes maximum in the vicinity of a tentative beat position away from the starting beat position by the beat interval "$\tau_{max}$". In other words, when the starting beat position is called $b_0$, the value of "s" which maximizes r(s) in the following expression 7 is obtained. In the expression, "s" indicates a shift from the tentative beat position and is an integer in the range shown in the expression 7. "F" is a fluctuation parameter; it is suitable to set "F" to about 0.1, but "F" may be set larger for a musical piece where tempo fluctuation is large. "n" needs to be set to about 5.

Figure 8:
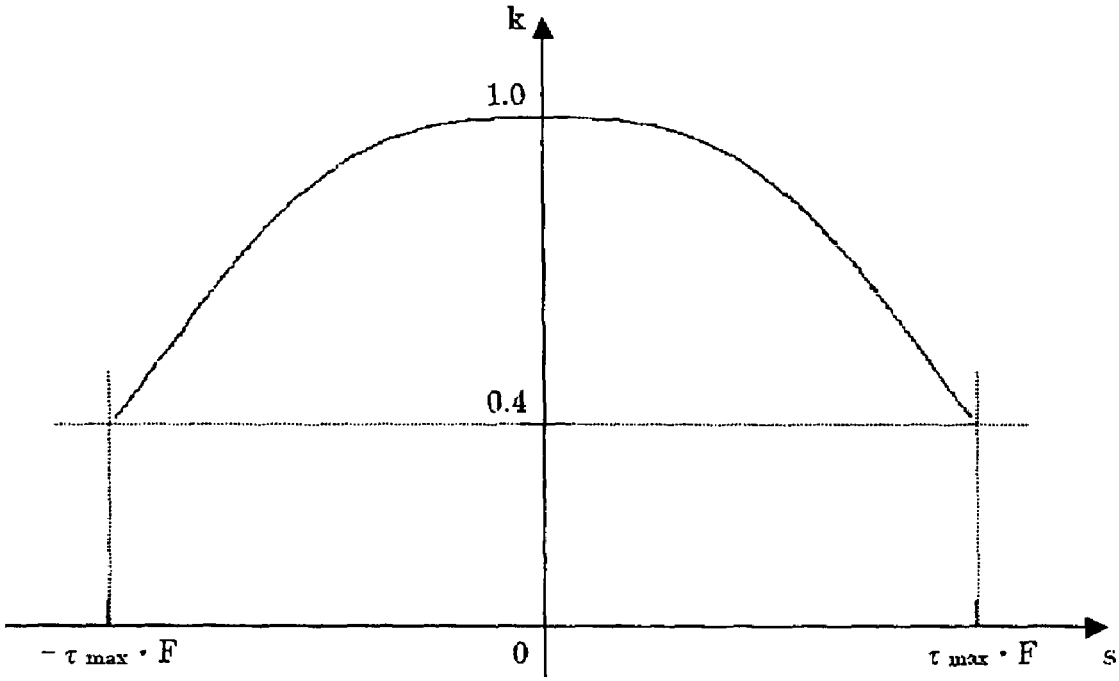
FIG. 8 is a graph showing the distribution of a coefficient "k" which changes according to the value of FIG. 9 is a view showing a method for determining second and subsequent beat positions.

In the expression, "k" is a coefficient that is changed according to the value of "s" and is assumed to have a normal distribution such as that shown in FIG. 8.

$$r(s) = \sum_{j=1}^{n} k \cdot L(b_0 + \tau_{\max} \cdot j + s) \quad \text{Expression 7}$$

$$(-\tau_{\max} \cdot F \leqq s \leqq \tau_{\max} \cdot F)$$

When the value of "s" that maximizes r(s) is found, the second beat position $b_1$ is calculated by the following expression 8.

$$b_1 = b_0 + \tau_{max} + s \quad \text{Expression 8}$$

The third beat position and subsequent beat positions can be obtained in the same way.

In a musical piece where the tempo hardly changes, beat positions can be obtained to the end of the musical piece by this method. However, in an actual performance, in some cases, the tempo fluctuates to some extent or becomes slow in parts.

To handle such tempo fluctuation, the following method can be used.

Figure 7:
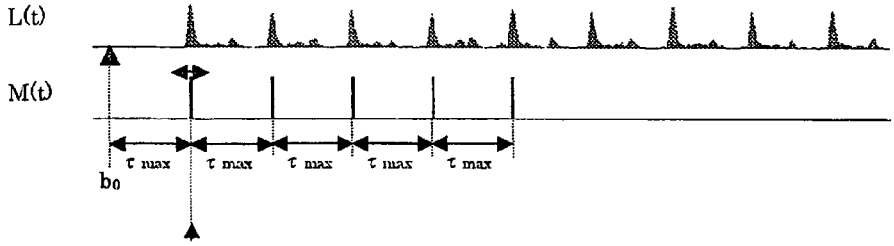
FIG. 7 is a view showing a method for determining subsequent beat positions after the staring beat position has been determined.
Figure 9:
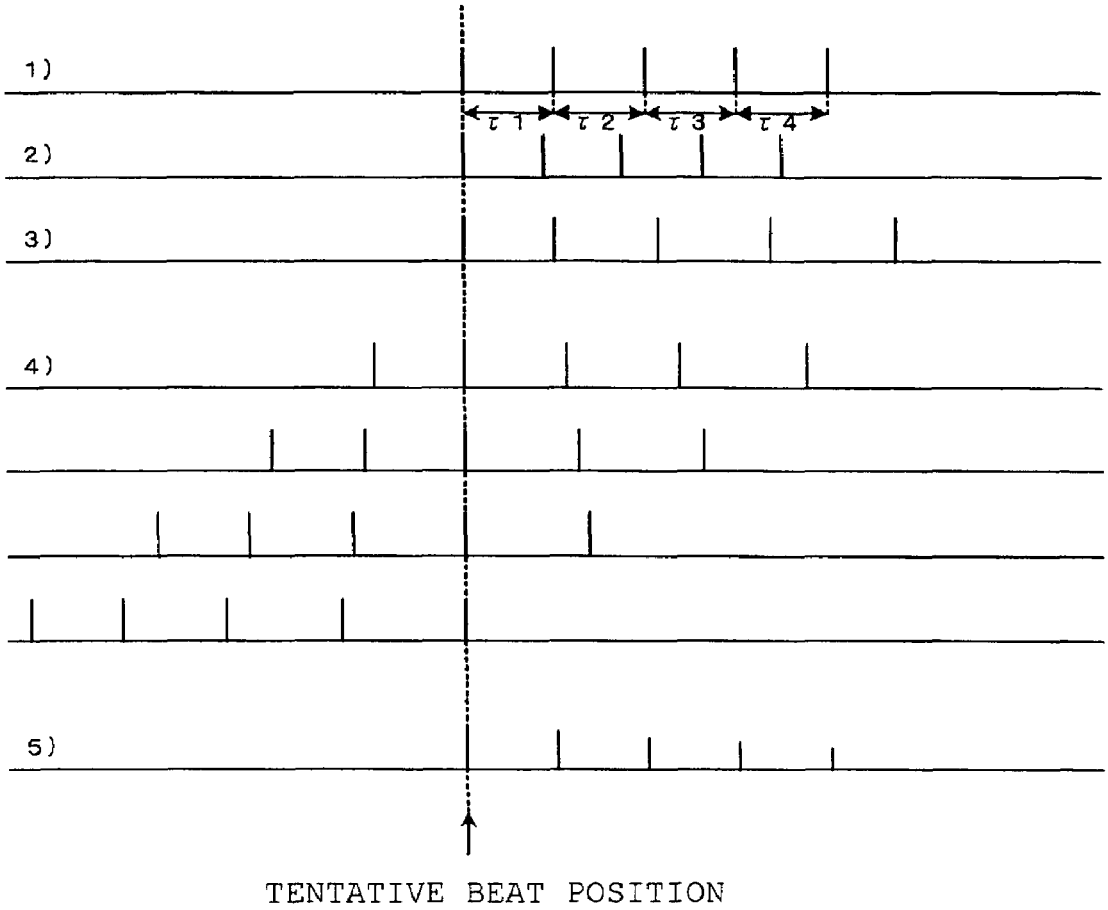

In the method, the function M(t) shown in FIG. 7 is changed as shown in FIG. 9. In FIG. 9, row 1 indicates the method described above, that is, $$\tau_1 = \tau_2 = \tau_3 = \tau_4 = \tau_{max}$$

where $\tau_1$, $\tau_2$, $\tau_3$, and $\tau_4$ indicate the time periods between pulses from the start, as shown in the figure. Row 2 indicates that the time periods $\tau_1$ to $\tau_4$ are equally made larger or smaller, that is, $$\tau_1 = \tau_2 = \tau_3 = \tau_4 = \tau_{max} + s \ (-\tau_{max} \times F \leqq s \leqq \tau_{max} \times F)$$

With this approach, beat positions can be obtained for a case where the tempo suddenly changes. Row 3 is for ritardando (rit.: gradually slower) or for accelerando (accel.: gradually faster), and the time periods between pulses are calculated as follows:

$$\tau_1 = \tau_{max}$$

$$\tau_2 = \tau_{max} + 1 \times s$$

$$\tau_3 = \tau_{max} + 2 \times s$$

$$\tau_4 = \tau_{max} + 4 \times s (-\tau_{max} \times F \leqq s \leqq \tau_{max} \times F)$$

The coefficients used here, 1, 2, and 4, are just examples and may be changed according to the magnitude of a tempo change. Row 4 indicates that the beat position currently to be obtained is set to any of the five pulse positions for rit. or accel. shown in Row 3.

When these are all combined and cross-correlation between L(t) and M(t) is obtained, beat positions can be determined from the maximum cross-correlation, even for a musical piece having a fluctuating tempo. When row 2 or row 3 is used, the value of the coefficient "k" used for correlation calculation also needs to be changed according to the value of "s".

The magnitudes of the five pulses are currently set to be the same. The total of the incremental values in power of the notes in the scale may be enhanced at the position where a beat is obtained by setting the magnitude of only the pulse at the position of the beat (indicated by a tentative beat position in FIG. 9) to be larger or by setting the magnitudes to be gradually smaller when the pulses are located farther from the position of the beat (indicated by row 5 in FIG. 9).

When the position of each beat is determined in the manner described above, the results are stored in the buffer 30. At the same time, the results may be displayed so that the user can check and correct them if they are wrong.

Figure 10:
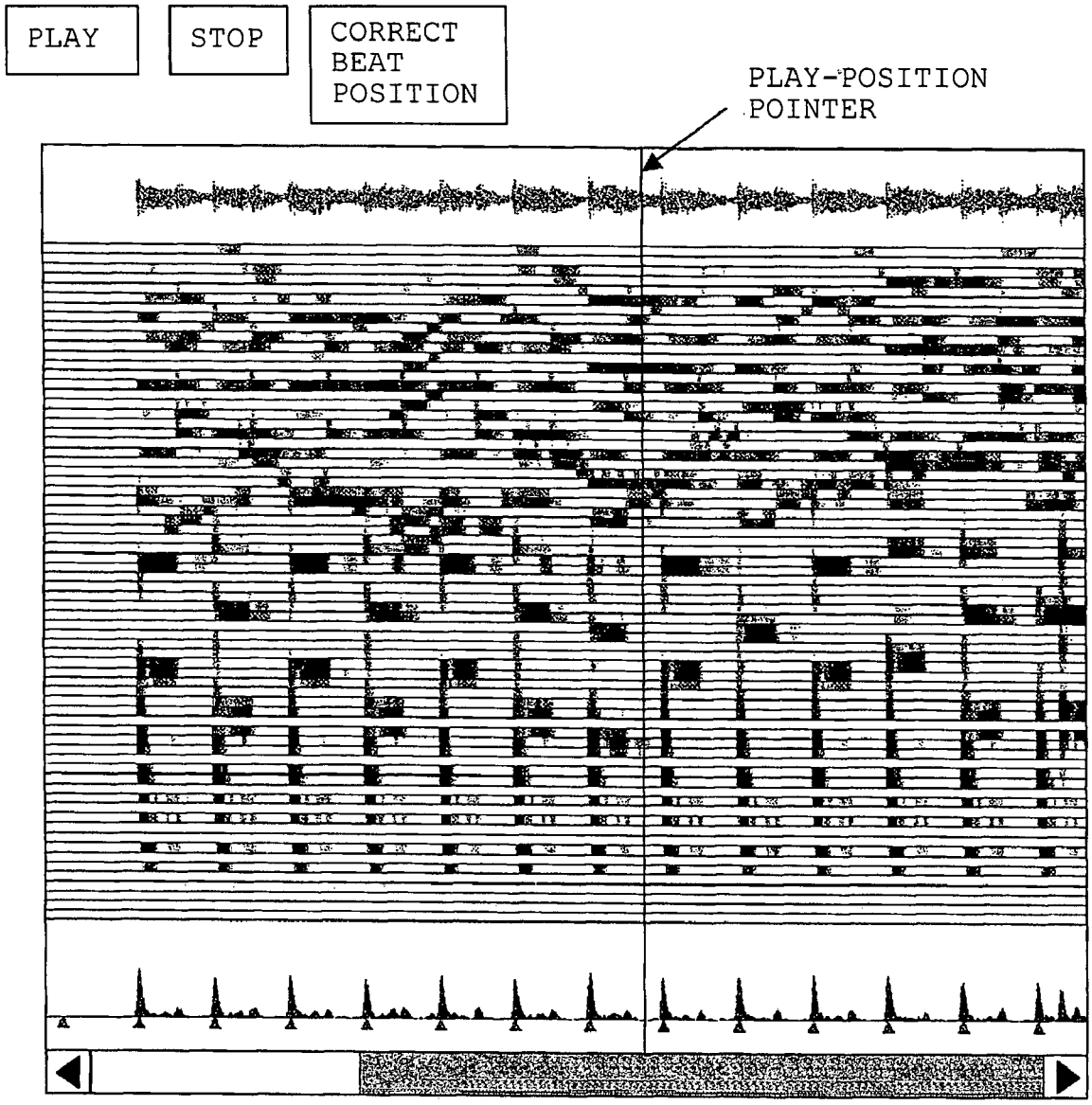
FIG. 10 is a view showing an example of a confirmation screen of beat detection results.

FIG. 10 shows an example of a confirmation screen of beat detection results. Triangular marks indicate the positions of detected beats.

When a "play" button is pressed, the current musical acoustic signal is D-A converted and played back from a speaker or the like. The current playback position is indicated by a play position pointer, such as the vertical line in the figure, and the user can check for errors in beat detection positions while listening to the music. Furthermore, when a sound such as that of a metronome is played back at beat-position timing in addition to the playback of the original waveform, checking can be performed not only visually but also aurally, facilitating determination of detection errors. As a method for playing back the sound of a metronome, for example, a MIDI unit can be used.

A beat-detection position is corrected by pressing a "correct beat position" button. When this button is pressed, a crosshairs cursor appears on the screen. If the starting beat position was erroneously detected, when the cursor is moved to the correct position and the mouse is clicked, all beat positions are cleared from a position a certain distance (for example, half of $\tau_{max}$) before the position where the mouse was clicked, the position where the mouse was clicked is set as a tentative beat position, and subsequent beat positions are detected again.

Next, detecting a meter and a bar will be described.

The beat positions are determined in the processing described above. The degree of change of all the notes for each beat is then obtained. The degree of a sound change for each beat is calculated from the power of each note in the scale for each frame interval, output from the scale-note-power detection section 2.

When the frame number of the j-th beat is called $b_j$ and the frames of the beats immediately therebefore and thereafter are called $b_{j-1}$ and $b_{j+1}$, the average of the powers of each note in the scale from frames $b_{j-1}$ to $b_{j-}1$ and the average of the powers of each note in the scale from frames $b_j$ to $b_{j+1}-1$ are calculated to obtain the incremental value; the degree of change of each note in the scale for each beat is obtained from the incremental value; and the total of the degrees of changes of the notes in the scale is calculated, which equals the degree of change of all the notes for the j-th beat.

In other words, when the power of the i-th note in the scale at frame time "t" is called $L_i(t)$, since the average of powers of the i-th note in the scale for the j-th beat, $L_{avgi}(j)$, is expressed by the following expression 9, the degree of a change of the i-th note in the scale for the j-th beat, $B_{addi}(j)$, is expressed by the following expression 10.

$$L_{avgi}(j) = \frac{\sum_{t=b_j}^{b_{j+1}-1} L_i(t)}{b_{j+1} - b_j} \qquad \text{Expression 9}$$

$$B_{addi}(j) = \begin{cases} L_{avgi}(j) - L_{avgi_1}(j-1) & (\text{when } L_{avgi}(j-1) \leqq L_{avgi}(j)) \\ 0 & (\text{when } L_{avgi}(j-1) > L_{avgi}(j)) \end{cases} \qquad \text{Expression 10}$$

Therefore, the degree of change of all the notes for the j-th beat, B(t), is expressed by the following expression 11, where T indicates the total number of notes in the scale.

$$B(j) = \sum_{i=O}^{T-1} B_{addi}(j) \qquad \text{Expression 11}$$

Figure 11:
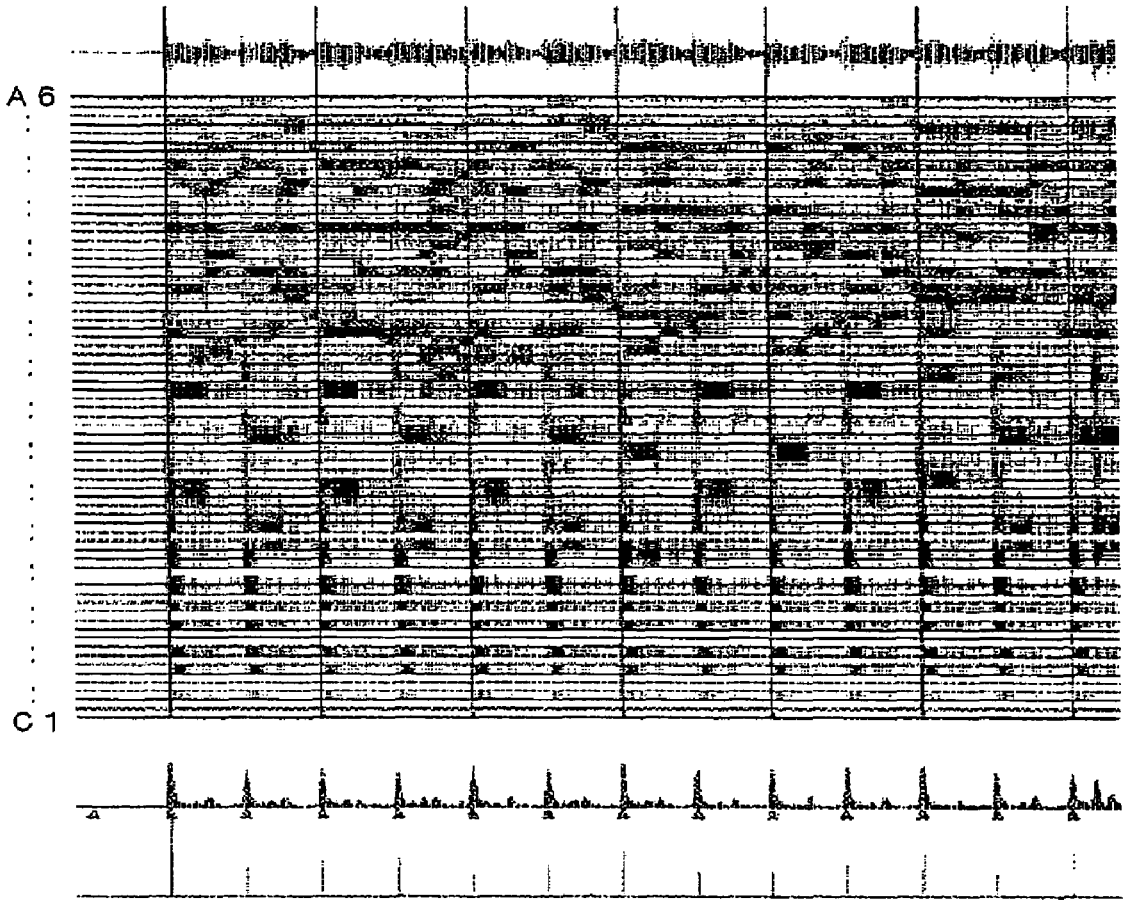
FIG. 11 is a view showing an example of a confirmation screen of bar detection results.

In FIG. 11, the lower row indicates the degree of a change of sound for each beat. From this degree of a change of sound for each beat, the meter and the position of the first beat are obtained.

The meter is obtained from the autocorrelation of the degree of a change in sound for each beat. Generally, it is thought that musical pieces have a sound change at the first beat. Therefore, the meter can be obtained from the autocorrelation of the degree of a change in sound for each beat. For example, by using the following expression 12, the autocorrelation $\phi(\tau)$ of the degree B(j) of a change in sound for each beat is obtained while the delay "$\tau$" is changed in the range from 2 to 4, and the delay "$\tau$" which maximizes the autocorrelation $\phi(\tau)$ is used as the number of beats per measure:

$$\phi(\tau) = \frac{\sum_{j=0}^{N-\tau-1} B(j) \cdot B(j+\tau)}{N - \tau} \qquad \text{Expression 12}$$

where N indicates the total number of beats, the autocorrelation $\phi(\tau)$ is obtained while the delay "$\tau$" is changed in the range from 2 to 4, and the delay "$\tau$" which maximizes the autocorrelation $\phi(\tau)$ is used as the number of beats per measure.

Next, the first beat is obtained. The position where the degree B(j) of a change in sound for each beat is maximum is set as the first beat. In other words, when "$\tau$" that maximizes $\phi(\tau)$ is called "$\tau_{max}$" and "k" that maximizes X(k) shown in the following expression 13 is called "$k_{max}$", the $k_{max}$-th beat indicates the position of the first beat, and the positions indicated by adding "$\tau_{max}$" successively to the $k_{max}$-th beat are the positions of subsequent beats:

$$X(k) = \frac{\sum_{n=0}^{n_{\max}} B(\tau_{\max} \cdot n + k)}{n_{\max} + 1} \quad (0 \leqq k < \tau_{\max}) \qquad \text{Expression 13}$$

where $n_{max}$ is the maximum "n", provided that $\tau_{max} \times n + k < N$.

When the meter and the position of the first beat (the position of a bar line) are determined in the manner described above, the results are stored in the buffer 40. At the same time, it is desired that the results be displayed on the screen to allow the user to change them.

Since this method cannot handle musical pieces having a changing meter, it is necessary to ask the user to specify a position where the meter is changed.

With the foregoing structure, from the acoustic signal of a human performance of a musical piece having a fluctuating tempo, the average tempo of the entire piece of music and the correct beat positions, as well as the meter of the musical piece and the position of the first beat, can be detected.

First Embodiment

Figure 12:
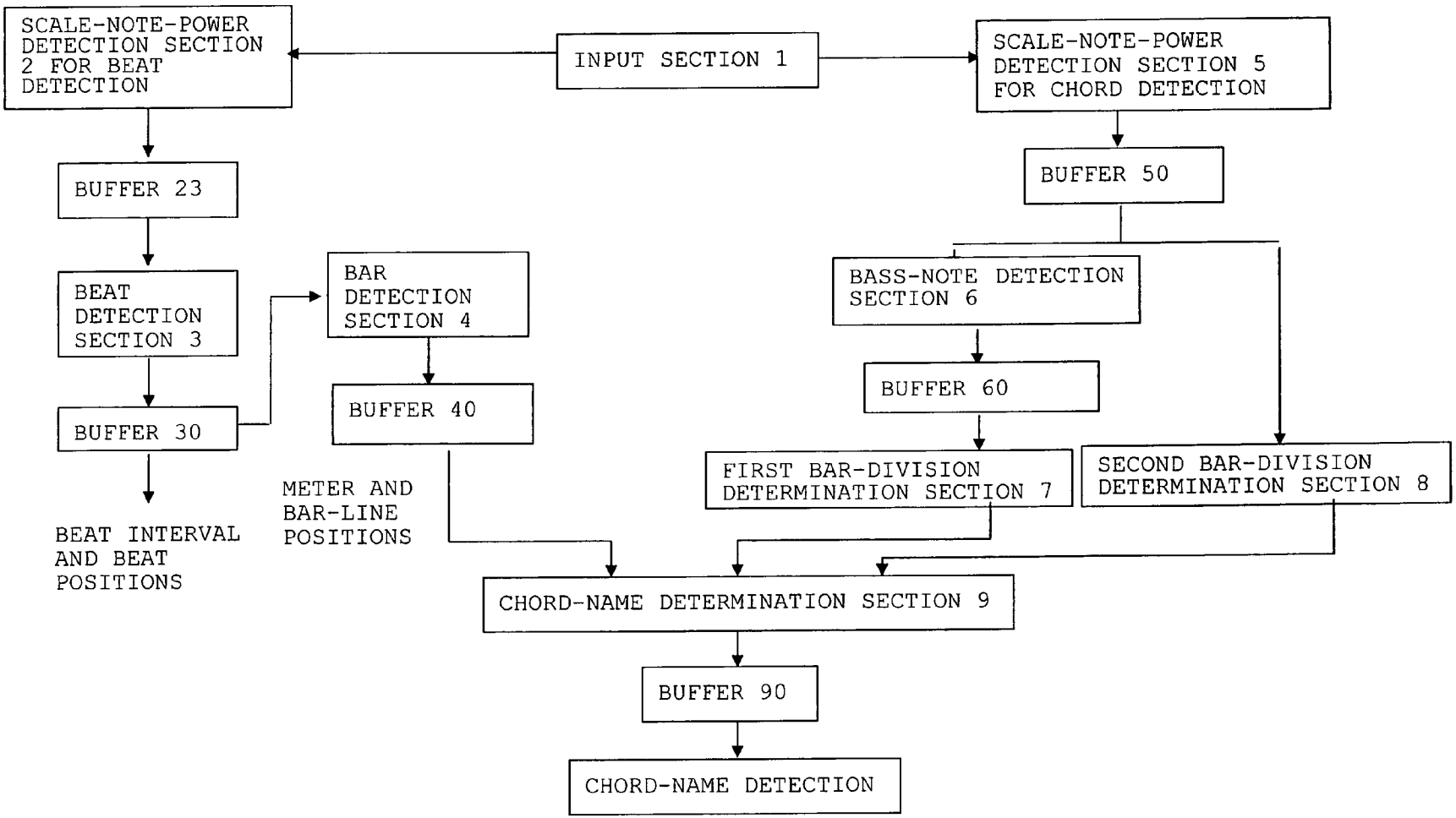
FIG. 12 is a block diagram of the chord-name detection apparatus according to a first embodiment of the present invention.

FIG. 12 is a block diagram of the chord-name detection apparatus according to a first embodiment of the present invention. In the figure, the structures of a beat detection section and a bar detection section are basically the same as those described above. Since the structures of a tempo detection part and a chord detection part are partially different from those described above, a description thereof will be made below without mathematical expressions, with some portions already mentioned above.

In the figure, the chord-name detection apparatus includes an input section 1 for receiving an acoustic signal; a scale-note-power detection section 2 for beat detection for applying FFT to the received acoustic signal at predetermined time intervals (frames) by using parameters suited to beat detection and for obtaining the power of each note in a scale at each frame interval from the obtained power spectrum; a beat detection section 3 for summing up, for all the notes in the scale, an incremental value of the power of each note in the scale at each frame interval to obtain the total of the incremental values of the powers, indicating the degree of change of all the notes at each frame interval, and for detecting an average beat interval and the position of each beat, from the total of the incremental values of the powers; a bar detection section 4 for calculating the average power of each note in the scale for each beat, for summing up, for all the notes, an incremental value of the average power of each note in the scale for each beat to obtain a value indicating the degree of change of all the notes at each beat, and for detecting a meter and the position of a bar line, from the value indicating the degree of change of all the notes at each beat; a scale-note-power detection section 5 for chord detection for applying FFT to the received acoustic signal at predetermined time intervals (frames) different from those used for beat detection described above, by using parameters suited to chord detection, and for obtaining the power of each note in the scale at each frame interval from the obtained power spectrum; a bass-note detection section 6 for setting several detection zones in each bar and for detecting a bass note in each of the detection zones from the power of a low note in the scale at a portion corresponding to a first beat in each of the detection zones among the detected power of each note in the scale; a first bar-division determination section 7 for determining whether the bass note is changed according to whether the detected bass note in each of the detection zones is different and for determining whether it is necessary to divide the bar into a plurality of portions according to whether the bass note is changed; a second bar-division determination section 8 for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for re-arranging the powers in descending order of strength, for determining whether a chord is changed according to whether C notes or more of the top M strongest notes, M being three or more, in the scale in a detection zone are included in the top N strongest notes, N being three or more, in the scale in the detection zone immediately therebefore, and for determining whether it is necessary to divide the bar into a plurality of portions according to the degree of change in the chord; and a chord-name determination section 9 for determining, when the first bar-division determination section 7 and/or the second bar-division determination section 8 determine that it is necessary to divide the bar into several chord detection zones, a chord name in each of the chord detection zones according to the bass note and the power of each note in the scale in each of the chord detection zones and for determining, when the first bar-division determination section 7 and the first and second bar-division determination section 8 determine that it is not necessary to divide the bar into several chord detection zones, a chord name in the bar according to the bass note and the power of each note in the scale in the bar.

The input section 1 receives a musical acoustic signal from which the chord is to be detected. Since the basic structure thereof is the same as the structure of the input section 1 of the previously developed apparatus, a detailed description thereof is omitted here. If a vocal sound, which is usually localized at the center, disturbs subsequent chord detection, the waveform at the right-hand channel may be subtracted from the waveform at the left-hand channel to cancel the vocal sound.

A digital signal output from the input section 1 is input to the scale-note-power detection section 2 for beat detection and to the scale-note-power detection section 5 for chord detection. Since these scale-note-power detection sections are each formed of the sections shown in FIG. 2 and have exactly the same structure, a single scale-note-power detection section can be used for both purposes with its parameters only being changed.

A waveform pre-processing section 20, which is used as a component thereof, has the same structure as described above and down-samples the acoustic signal sent from the input section 1, at a sampling frequency suited to the subsequent processing. The sampling frequency after downsampling, that is, the down-sampling rate, may be changed between beat detection and chord detection, or may be identical to save the down-sampling time.

In beat detection, the down-sampling rate is determined according to a range used for beat detection. To use the performance sounds of rhythm instruments having a high range, such as cymbals and hi-hats, for beat detection, it is necessary to set the sampling frequency after down-sampling to a high frequency. To mainly use the bass note, the sounds of musical instruments such as bass drums and snare drums, and the sounds of musical instruments having a middle range for beat detection, the same down-sampling rate as that employed in the following chord detection may be used.

The down-sampling rate used in the waveform pre-processing section for chord detection is changed according to a chord-detection range. The chord-detection range means a range used for chord detection in the chord-name determination section. When the chord-detection range is the range from C3 to A6 (C4 serves as the center "do"), for example, since the fundamental frequency of A6 is about 1,760 Hz (when A4 is set to 440 Hz), the sampling frequency after down-sampling needs to be 3,520 Hz or higher, and the Nyquist frequency is thus 1,760 Hz or higher. Therefore, when the original sampling frequency is 44.1 kHz (which is used for music CDs), the down-sampling rate needs to be about one twelfth. In this case, the sampling frequency after down-sampling is 3,675 Hz.

Usually in down-sampling processing, a signal is passed through a low-pass filter which removes components having the Nyquist frequency (1,837.5 Hz in the current case), that is, half of the sampling frequency after down-sampling, or higher, and then data in the signal is skipped (11 out of 12 waveform samples are discarded in the current case). The same reason applies as that described above.

When down-sampling is finished in this way in the waveform pre-processing section 20, an FFT calculation section 21 applies a fast Fourier transform (FFT) to the output signal of the waveform pre-processing section at predetermined time intervals.

FFT parameters (number of FFT points and FFT window shift) are set to different values between beat detection and chord detection. If the number of FFT points is increased to increase the frequency resolution, the FFT window size is enlarged to use a longer time period for one FFT cycle, reducing the time resolution. This FFT characteristic needs to be taken into account. (In other words, for beat detection, it is better to increase the time resolution with the frequency resolution suppressed.) There is a method in which, instead of using a waveform having the same length as the window length, waveform data is specified only for a part of the window and the remaining part is filled with zeros to increase the number of FFT points without suppressing the time resolution. However, the number of waveform samples needs to be set up to a certain point in order to also detect low-note power correctly in the case of the present embodiment.

The above points have been taken into account. In the present embodiment, in beat detection, the number of FFT points is set to 512, the window shift is set to 32 samples (window overlap is 15/16), and filling with zeros is not performed; and, in chord detection, the number of FFT points is set to 8,192, the window shift is set to 128 samples (window overlap is 63/64), and 1,024 waveform samples are used in one FFT cycle. When the FFT calculation is performed with these settings, the time resolution is about 8.7 ms and the frequency resolution is about 7.2 Hz in beat detection; and the time resolution is about 35 ms and the frequency resolution is about 0.4 Hz in chord detection. Since each note in the scale of which the power is to be obtained falls in the range from C1 to A6, a frequency resolution of about 0.4 Hz in chord detection is sufficient because the smallest frequency difference in fundamental frequency, which is between C1 and C#1, is about 1.9 Hz. A time resolution of 8.7 ms in beat detection is sufficient because the length of a thirty-second note is 25 ms in a musical piece having a tempo of 300 quarter notes per minute.

The FFT calculation is performed in this way in each frame interval; the squares of the real part and the imaginary part of the FFT result are added and the sum is square-rooted to calculate the power spectrum; and the power spectrum is sent to a power detection section 22.

The power detection section 22 calculates the power of each note in the scale from the power spectrum calculated in the FFT calculation section 21. The FFT calculates just the powers of frequencies that are integer multiples of the value obtained when the sampling frequency is divided by the number of FFT points. Therefore, the same process as that described above is performed to detect the power of each note in the scale from the power spectrum. Specifically, the power of the spectrum having the maximum power among power spectra corresponding to the frequencies falling in the range of 50 cents (100 cents correspond to one semitone) above and below the fundamental frequency of each note (from C1 to A6) in the scale is set to the power of the note.

When the powers of all the notes in the scale have been detected, they are stored in buffers. The waveform reading position is advanced by a predetermined time interval (one frame, which corresponds to 32 samples for beat detection and to 128 samples for chord detection in the previous case), and the processes in the FFT calculation section 21 and the power detection section 22 are performed again. This set of steps is repeated until the waveform reading position reaches the end of the waveform.

With the above-described processing, the power of each note in the scale for each frame interval for the acoustic signal input to the input section 1 is stored in a buffer 23 and a buffer 50 for beat detection and chord detection, respectively.

Next, since the beat detection section 3 and the bar detection section 4 in FIG. 12 have the same structures as the beat detection section 3 and the bar detection section 4 described above, detailed descriptions thereof are omitted here.

The positions of bar lines (frame number of each bar) are determined in the same procedure by the same structure as described above. Then, the bass note in each bar is detected.

The bass note is detected from the power of each note in the scale for each frame interval, output from the scale-note-power detection section 5 for chord detection.

Figure 13:
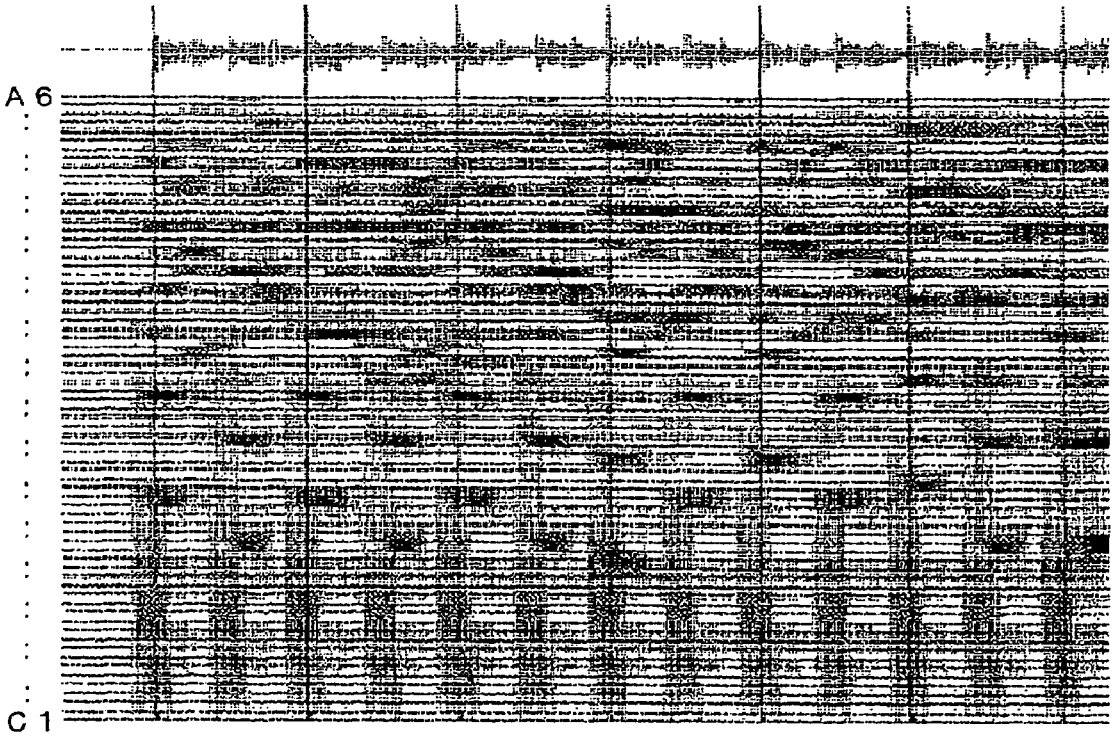
FIG. 13 is a graph showing the power of each note in the scale at each frame interval in the same part as that shown in FIG. 4, output from a scale-note-power detection section for chord detection.

FIG. 13 shows the power of each note in the scale for each frame interval at the same portion in the same musical piece as that shown in FIG. 4, output from the scale-note-power detection section 5 for chord detection. As shown in the figure, since the frequency resolution in the scale-note-power detection section 5 for chord detection is about 0.4 Hz, the powers of all the notes from C1 to A6 are extracted.

In the previously developed apparatus, since it is possible that the bass note differs between a first half and a second half in a bar, each bar is divided into a first half and a second half; a bass note is detected in each half; and when different bass notes are detected in the first half and the second half, the chord is also detected in each of the first half and the second half. In that method, however, when different chords are used but an identical bass note is detected, for example, when the C chord is used in the first half of a bar and the Cm chord is used in the second half, since the bass note is identical, the bar is not divided and the C chord is detected in the whole bar.

In addition, in the above apparatus, the bass note is detected in the entire detection zone. In other words, when the detection zone is a bar, a strong note in the entire bar is detected as the bass note. In jazz music where the bass note changes frequently (the bass note changes in units of quarter notes or the like), however, the bass note cannot be detected correctly with this method.

Therefore, in the structure of the present embodiment, when the bass-note detection section 6 detects a bass note, several detection zones are specified in each bar, and the bass note in each detection zone is detected from the power of a low note in the scale corresponding to the first beat in each detection zone among the detected powers of the notes in the scale. This is because the root notes of the chord are played at the first beat in many cases even when the bass note changes frequently, as described above.

The bass note is obtained from the average strength of the powers of notes in the scale in a bass-note detection range at a portion corresponding to the first beat in the detection zone.

When the power of the i-th note in the scale at frame time "t" is called $L_i(t)$, the average power $L_{avgi}(f_s, f_e)$ of the i-th note in the scale from frame $f_s$ to frame $f_e$ can be calculated by the following expression 14:

Expression 14

$$L_{avgi}(f_s, f_e) = \frac{\sum_{t=f_s}^{f_e} L_i(t)}{f_e - f_s + 1} \quad (f_s \leqq f_e)$$

The bass-note detection section 6 calculates the average powers in the bass-note detection range, for example, in the range from C2 to B3, and determines the note having the largest average power in the scale as being the bass note. To prevent the bass note from being erroneously detected in a musical piece where no sound is included in the bass-note detection range or in a portion where no sound is included, an appropriate threshold may be specified so that the bass note is ignored if the power of the detected bass note is equal to or smaller than the threshold. When the bass note is regarded as an important factor in subsequent chord detection, it may be determined whether the detected bass note continuously keeps a predetermined power or more during the bass-note detection zone for the first beat, in order to select only a more reliable one as the bass note. Further, instead of determining the note having the largest average power in the scale in the bass-note detection range as being the bass note, the bass note may be determined such that the average power for each note is used to calculate the average power for each of 12 pitch names, the pitch name having the largest average power is determined to be the base pitch name, and the note having the largest average power in the scale among the notes included in the bass-note detection range, having the base pitch name is determined as being the bass note.

When the bass note is determined, the result is stored in a buffer 60. The bass-note detection result may be displayed on the screen to allow the user to correct it if it is wrong. Since the base range may change, depending on the musical piece, the user may be allowed to change the bass-note detection range.

Figure 14:
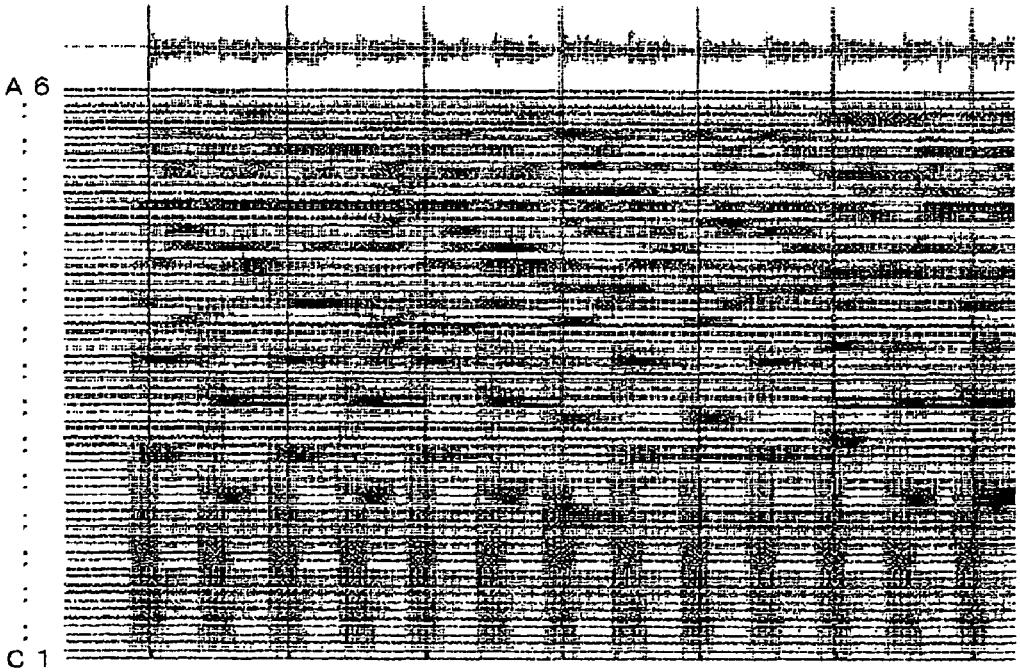
FIG. 14 is a graph showing a display example of bass-note detection results obtained by a bass note detection section.

FIG. 14 shows a display example of the bass-note detection result obtained by the bass-note detection section 6.

Next, the first bar-division determination section 7 determines whether the bass note changes according to whether the detected bass note differs in each detection zone and determines whether it is necessary to divide the bar into a plurality of portions according to whether the bass note changes. In other words, when the detected bass note is identical in each detection zone, it is determined that it is not necessary to divide the bar; in contrast, when the detected bass note differs in each detection zone, it is determined that it is necessary to divide the bar into a plurality of portions. In the latter case, it may be determined again whether it is necessary to divide each half of the plurality of portions further.

The second bar-division determination section 8 first specifies a chord detection range. The chord detection range is a range where chords are mainly played and is assumed, for example, to be in the range from C3 to E6 (C4 serves as the center "do").

The power of each note in the scale for each frame interval in the chord detection range is averaged in a detection zone, such as half of a bar. The averaged power of each note in the scale is summed up for each of 12 pitch notes (C, C#, D, D#, . . . , and B), and the summed-up power is divided by the number of powers summed up to obtain the average power of each of the 12 pitch notes.

The average powers of the 12 pitch notes are obtained in the chord detection range for the first half and second half of the bar and are re-arranged in descending order of strength.

Figure 15A:
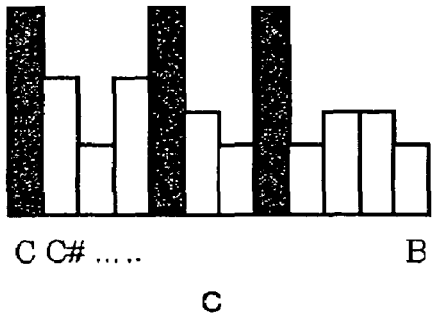
FIG. 15A and FIG. 15B are views showing the power of each note in the scale in a first half and a second half of a bar, respectively.
Figure 15B:
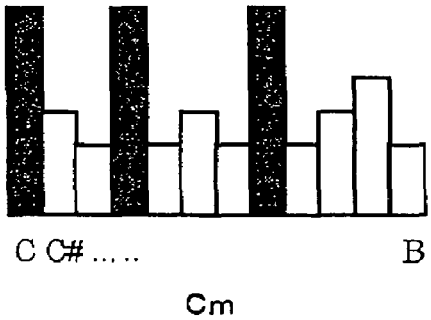

As shown in FIG. 15A and FIG. 15B, it is determined whether the top three (this number is called "M") notes, for example, in strength in the second half are included in the top three (this number is called "N") notes, for example, in strength in the first half, and it is determined whether the chord changes according to whether the M notes or more are included. According to this determination, the second bar-division determination section 8 determines the degree of change in chord and determines, according to the result, whether it is necessary to divide the bar into a plurality of portions.

When the three notes (this number is called "C") or more are included (that is, all three are included), the second bar-division determination section 8 determines that the chord does not change between the first half and the second half of the bar and further determines that the division of the bar due to the degree of change in chord need not be performed.

Changing the values of "M", "N", and "C" used in the second bar-division determination section 8 changes how the bar is divided depending on the degree of change in the chord. In the foregoing example, where "M", "N", and "C" are all set to "3", a change in the chord is rather strictly checked. When "M" is set to "3", "N" is set to "6", and "C" is set to "3" (which means determining whether the top three notes in the second half are all included in the top six notes in the first half), for example, it is determined that pieces of sound similar to each other to some extent have an identical chord.

A description has been given in which the first half and the second half are each further divided into two halves to have four divisions in the bar in the quadruple meter. A more correct determination suited to actual general music can be made when "M" is set to "3", "N" is set to "3", and "C" is set to "3" to determine whether to divide the bar into the first half and the second half and when "M" is set to "3", "N" is set to "6", and "C" is set to "3" to determine whether to divide each of the first half and the second half into two further halves.

The chord-name determination section 9 determines the chord name in each chord detection zone according to the bass note and the power of each note in the scale in each chord detection zone when the first bar-division determination section 7 and/or the second bar-division determination section 8 determine that it is necessary to divide the bar into several chord detection zones, or determines the chord name in the bar according to the bass note and the power of each note in the scale in the bar when the first bar-division determination section 7 and the second bar-division determination section 8 determine that it is not necessary to divide the bar into several chord detection zones.

The chord-name determination section 9 actually determines the chord name in the following way. In the present embodiment, the chord detection zone and the bass-note detection zone are the same. The average power of each note in the scale in a chord detection range, for example, in the range from C3 to A6, is calculated in the chord detection zone, the names of several top notes in average power are detected, and chord-name candidates are selected according to the names of these notes and the name of the bass note.

Since a note having a large power is not necessarily a component of the chord, several notes, such as five notes, are detected, all combinations of at least two of those notes are found, and chord-name candidates are selected according to the names of the notes in all the combinations and the name of the bass note.

Also in chord detection, notes having average powers which are not larger than a threshold may be ignored. In addition, the user may be allowed to change the chord detection range. Furthermore, instead of extracting chord-component candidates sequentially from the note having the largest average power in the scale in the chord detection range, the average power of each note in the chord detection range may be used to calculate the average power for each of 12 pitch names to extract chord-component candidates sequentially from the pitch name having the largest average power.

To extract chord-name candidates, the chord-name determination section 9 searches a chord-name data base which stores intervals from chord types (such as "m" and M7") and the root notes of chord-component notes. Specifically, all combinations of at least two of the five detected note names are extracted; it is determined whether the intervals among these extracted notes match the intervals among chord-component notes stored in the chord-name data base, one by one; when they match, the root note is found from the name of a note included in the chord-component notes; and a chord symbol is assigned to the name of the note of the root note to determine the chord name. Since a root note or a fifth note of a chord may be omitted in a musical instrument that plays the chord, even if these types of notes are not included, the corresponding chord-name candidates are extracted. When the bass note is detected, the note name of the bass note is added to the chord names of the chord-name candidates. In other words, when a root note of a chord and the bass note have the same note name, nothing needs to be done. When they differ, a fraction chord is used.

If too many chord-name candidates are extracted in the above-described method, a restriction may be applied according to the bass note. Specifically, when the bass note is detected, if the bass-note name is not included in the root names of any chord-name candidate, the chord-name candidate is deleted.

When a plurality of chord-name candidates are extracted, the chord-name determination section 9 calculates a likelihood (how likely it is to happen) in order to select one of the plurality of chord-name candidates.

The likelihood is calculated from the average of the strengths of the powers of all chord-component notes in the chord detection range and the strength of the power of the root notes of the chord in the bass-note detection range. Specifically, when the average of the average powers of all component notes of an extracted chord-name candidate in the chord detection zone is called $L_{avgc}$ and the average power of the root notes of the chord in the bass-note detection zone is called $L_{avgr}$, the likelihood is calculated as the average of these two averages as shown in the following expression 15. According to another method, the likelihood may be calculated as the ratio in (average) power between a chord tone (chord-component notes) and a non-chord tone (note other than chord-component notes) in the chord detection range.

$$\text{Likelihood} = \frac{L_{avgc} + L_{avgr}}{2} \qquad \text{Expression 15}$$

When a plurality of notes having the same pitch name is included in the chord detection range or in the bass-note detection range, the note having the strongest average power among them is used in the chord detection range or in the bass-note detection range. Alternatively, the average power of each note in the scale may be averaged for the 12 pitch names to use the average power for each of the 12 pitch names in each of the chord detection range and the bass-note detection range.

Further, musical knowledge may be introduced into the calculation of the likelihood. For example, the power of each note in the scale is averaged in all frames; the averaged power of each note in the scale is averaged for each of the 12 pitch names to calculate the strength of each of the 12 pitch names, and the tune of the musical piece is detected from the distribution of the strength. The diatonic chord of the tune is multiplied by a prescribed constant to increase the likelihood. Or, the likelihood is reduced for a chord having a component note(s) which is outside the notes in the diatonic scale of the tune, according to the number of the notes outside the notes in the diatonic scale of the tune. Further, patterns of common chord progressions may be stored in a data base so that the likelihood for a chord candidate which is found, in comparison with the data base, to be included in the patterns of common chord progressions is increased by being multiplied by a prescribed constant.

The name of the chord having the greatest likelihood is determined to be the chord name. Chord-name candidates may be displayed together with their likelihood to allow the user to select the chord name.

In either of these cases, when the chord-name determination section 9 determines the chord name, the result is stored in a buffer 90 and is also displayed on the screen.

Figure 16:
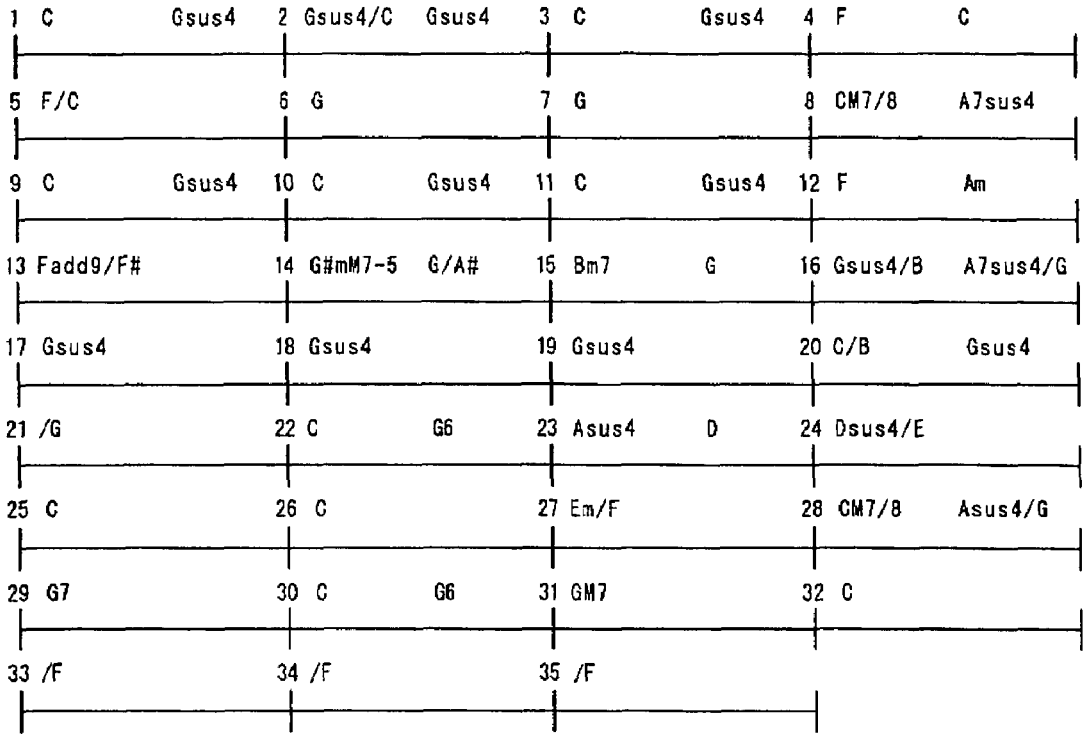
FIG. 16 is a view showing an example of a confirmation screen of chord detection results.

FIG. 16 shows a display example of chord detection results obtained by the chord-name determination section 9. It is preferred that the detected chords and the bass notes be played back by using a MIDI unit or the like in addition to displaying, in this way, the detected chords on the screen. This is because, in general, it cannot be determined whether the displayed chords are correct, just by looking at the names of the chords.

According to the configuration of the present embodiment described above, even persons other than professionals having special musical knowledge can detect chord names in an input musical acoustic signal in which the sounds of a plurality of musical instruments are mixed, such as those in music CDs, from the overall sound without detecting each piece of musical-note information.

Further, according to the configuration of the present embodiment, chords having the same component notes can be distinguished. Even if the performance tempo fluctuates, or even for a sound source that outputs a performance whose tempo is intentionally fluctuated, the chord name in each bar can be detected.

In particular, in the configuration of the present embodiment, since the bar is divided according to not only the bass note but also the degree of change in the chord to detect the chord, even if the bass note is identical, when the degree of change in the chord is large, the bar is divided and the chords are detected. In other words, if the chord changes in a bar with an identical bass note being maintained, for example, the correct chords can be detected. The bar can be divided in various ways according to the degree of change in the bass note and the degree of change in the chord.

Second Embodiment

A second embodiment of the present invention differs from the first embodiment in that the Euclidean distance of the power of each note in the scale is calculated to determine the degree of change in the chord to divide a bar and to detect chords.

Figure 17A:
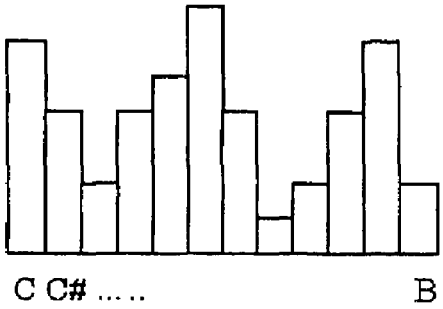
FIGS. 17A to 17D are views showing an outline method for calculating the Euclidean distance of the power of each note in the scale, performed by a second bar-division determination section.
Figure 17B:
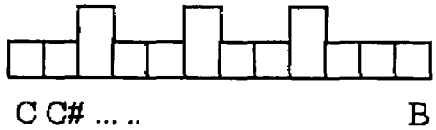
Figure 17B:
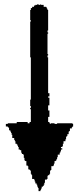
Figure 17C:
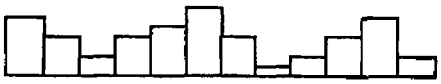
Figure 17D:
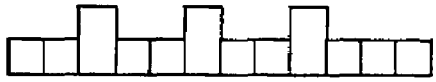

In that case, however, if the Euclidean distance is simply calculated, it becomes large at a sudden sound increase (at the start of a musical piece or the like) and a sudden sound attenuation (at the end of a musical piece or a break), causing the risk of dividing the bar just due to magnifications of the sound even though the chord actually has no change. Therefore, before the Euclidean distance is calculated, the power of each note in the scale is normalized as shown in FIG. 17A to 17D (the powers shown in FIG. 17A are normalized to those shown in FIG. 17C, and the powers shown in FIG. 17B are normalized to those shown in FIG. 17D). When normalization to the smallest power, not to the largest power, is performed (see FIGS. 17A to 17D), the Euclidean distance is reduced at a sudden sound change, eliminating the risk of erroneously dividing the bar.

The Euclidean distance of the power of each note in the scale is calculated according to the above-described expression 16. When the Euclidean distance is larger than the average of the powers of all notes in all frames, for example, the first bar-division determination section 7 determines that the bar should be divided.

To be more detailed, when the Euclidean distance is larger than "T" multiplied by the average of the powers of all the notes in all the frames, it is necessary to divide the bar. When the value "T" is changed, the bar-division threshold can be changed (adjusted) to a desired value.

The chord-name detection apparatus and the chord-name detection program according to the present invention are not limited to those described above with reference to the drawings, and can be modified in various manners within the scope of the present invention.

The chord-name detection apparatus and the chord-name detection program according to the present invention can be used in various fields, such as video editing processing for synchronizing events in a video track with beat timing in a musical track when a musical promotion video is created; audio editing processing for finding the positions of beats by beat tracking and for cutting and pasting the waveform of an acoustic signal of a musical piece; live-stage event control for controlling elements such as the color, brightness, direction and special lighting effect in synchronization with a human performance and for automatically controlling audience hand clapping time and audience cries of excitement; and computer graphics in synchronization with music.

The entire disclosure of Japanese Patent Application No. 2006-216361, filed on Aug. 9, 2006, including specification, claims, drawings and summary, is incorporated herein by reference in its entirety.

What is claimed is:

1. A chord-name detection apparatus comprising:

input means for receiving an acoustic signal;

first scale-note-power detection means for applying a fast Fourier transform (FFT) to the received acoustic signal at predetermined frame intervals by using parameters suited to beat detection and for obtaining the power of each note in a scale at each frame interval from the obtained power spectrum;

beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers;

bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat;

second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum;

bass-note detection means for setting several detection zones in each bar and for detecting a bass note in each of the detection zones from the power of a low note in the scale at a portion corresponding to a first beat in each of the detection zones among the detected power of each note in the scale;

first bar-division determination means for determining whether the bass note is changed according to whether the detected bass note in each of the detection zones is different and for determining whether it is necessary to divide the bar into a plurality of portions according to whether the bass note is changed;

second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for re-arranging the powers in descending order of strength, for determining whether a chord is changed according to whether C notes or more of the top M strongest notes, M being three or more, in the scale in a detection zone are included in the top N strongest notes, N being three or more, in the scale in the detection zone immediately therebefore, and for determining whether it is necessary to divide the bar into a plurality of portions according to the degree of change in the chord; and chord-name determination means for determining, when the first bar-division determination means and/or the second bar-division determination means determine that it is necessary to divide the bar into several chord detection zones, a chord name in each of the chord detection zones according to the bass note and the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

2. A chord-name detection apparatus comprising:

input means for receiving an acoustic signal;

first scale-note-power detection means for applying a fast Fourier transform (FFT) to the received acoustic signal at predetermined frame intervals by using parameters suited to beat detection and for obtaining the power of each note in a scale at each frame interval from the obtained power spectrum;

beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers;

bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat;

second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum;

bass-note detection means for setting several detection zones in each bar and for detecting a bass note in each of the detection zones from the power of a low note in the scale at a portion corresponding to a first beat in each of the detection zones among the detected power of each note in the scale;

first bar-division determination means for determining whether the bass note is changed according to whether the detected bass note in each of the detection zones is different and for determining whether it is necessary to divide the bar into a plurality of portions according to whether the bass note is changed;

second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for normalizing the average power of each of the 12 pitch notes in the scale to the smallest power, for calculating the Euclidean distance of the normalized power of each of the 12 pitch notes in the scale, for determining whether a chord is changed according to whether the Euclidean distance is larger than "T" multiplied by the average of the powers of all the notes in all the frames, the Euclidean distance is larger than "T" multiplied by the average of the powers of all the notes in all the frames, and for determining whether it is necessary to divide the bar into a plurality of portions according to the degree of change in the chord; and chord-name determination means for determining, when the first bar-division determination means and/or the second bar-division determination means determine that it is necessary to divide the bar into several chord detection zones, a chord name in each of the chord detection zones according to the bass note and the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

3. A chord-name detection program read and executed by a computer to cause the computer to function as:

input means for receiving an acoustic signal;

first scale-note-power detection means for applying a fast Fourier transform (FFT) to the received acoustic signal at predetermined frame intervals by using parameters suited to beat detection and for obtaining the power of each note in a scale at each frame interval from the obtained power spectrum;

beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers;

bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat;

second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum;

bass-note detection means for setting several detection zones in each bar and for detecting a bass note in each of the detection zones from the power of a low note in the scale at a portion corresponding to a first beat in each of the detection zones among the detected power of each note in the scale;

first bar-division determination means for determining whether the bass note is changed according to whether the detected bass note in each of the detection zones is different and for determining whether it is necessary to divide the bar into a plurality of portions according to whether the bass note is changed;

second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for re-arranging the powers in descending order of strength, for determining whether a chord is changed according to whether C notes or more of the top M strongest notes, M being three or more, in the scale in a detection zone are included in the top N strongest notes, N being three or more, in the scale in the detection zone immediately therebefore, and for determining whether it is necessary to divide the bar into a plurality of portions according to the degree of change in the chord; and chord-name determination means for determining, when the first bar-division determination means and/or the second bar-division determination means determine that it is necessary to divide the bar into several chord detection zones, a chord name in each of the chord detection zones according to the bass note any the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

4. A chord-name detection program read and executed by a computer to cause the computer to function as:

input means for receiving an acoustic signal;

first scale-note-power detection means for applying a fast Fourier transform (FFT) to the received acoustic signal at predetermined frame intervals by using parameters suited to beat detection and for obtaining the power of each note in a scale at each frame interval from the obtained power spectrum;

beat detection means for summing up, for all the notes in the scale, an incremental value of the power of each note in the scale at the predetermined frame intervals to obtain the total of the incremental values of the powers, indicating the degree of change of all the notes at each frame interval, and for detecting an average beat interval and the position of each beat, from the total of the incremental values of the powers;

bar detection means for calculating the average power of each note in the scale for each beat, for summing up, for all the notes in the scale, an incremental value of the average power of each note in the scale for each beat to obtain a value indicating the degree of change of all the notes at each beat, and for detecting a meter and the position of a bar line, from the value indicating the degree of change of all the notes at each beat;

second scale-note-power detection means for applying FFT to the received acoustic signal at predetermined frame intervals different from those used for the beat detection, by using parameters suited to chord detection, and for obtaining the power of each note in the scale at each frame interval from the obtained power spectrum;

bass-note detection means for setting several detection zones in each bar and for detecting a bass note in each of the detection zones from the power of a low note in the scale at a portion corresponding to a first beat in each of the detection zones among the detected power of each note in the scale;

first bar-division determination means for determining whether the bass note is changed according to whether the detected bass note in each of the detection zones is different and for determining whether it is necessary to divide the bar into a plurality of portions according to whether the bass note is changed;

second bar-division determination means for setting several chord detection zones in the bar, for averaging the power of each note in the scale for each frame interval in each of the chord detection zones in a chord detection range specified as a range where chords are mainly performed, for summing up the averaged power of each note in the scale for each of 12 pitch notes in the scale, for dividing the total for each of the 12 pitch notes by the number of summed-up powers to obtain the average power of each of the 12 pitch notes in the scale, for normalizing the average power of each of the 12 pitch notes in the scale to the smallest power, for calculating the Euclidean distance of the normalized power of each of the 12 pitch notes in the scale, for determining whether a chord is changed according to whether the Euclidean distance is larger than "T" multiplied by the average of the powers of all the notes in all the frames, the Euclidean distance is larger than "T" multiplied by the average of the powers of all the notes in all the frames, and for determining whether it is necessary to divide the bar into a plurality of portions according to the degree of change in the chord; and chord-name determination means for determining, when the first bar-division determination means and/or the second bar-division determination means determine that it is necessary to divide the bar into several chord detection zones, a chord name in each of the chord detection zones according to the bass note and the power of each note in the scale in each of the chord detection zones and for determining, when the first bar-division determination means and the first and second bar-division determination means determine that it is not necessary to divide the bar into several chord detection zones, a chord name in the bar according to the bass note and the power of each note in the scale in the bar.

* * * * *

UNITED STATES PATENT AND TRADEMARK OFFICE

CERTIFICATE OF CORRECTION

PATENT NO. : 7,485,797 B2
APPLICATION NO. : 11/780717
DATED : February 3, 2009
INVENTOR(S) : Ren Sumita It is certified that error appears in the above-identified patent and that said Letters Patent is hereby corrected as shown below:

Please replace Expression 10 in column 16 with the following:

$$B_{addi}(j)=\begin{cases} L_{avgi}(j)-L_{avgi}(j-1) & (\text{when } L_{avgi}(j-1)\leq L_{avgi}(j)) \\ 0 & (\text{when } L_{avgi}(j-1)>L_{avgi}(j)) \end{cases}$$

Signed and Sealed this

Thirty-first Day of March, 2009

John Doll

JOHN DOLL
*Acting Director of the United States Patent and Trademark Office*